US010816009B2

(12) United States Patent
Lörcher et al.

(10) Patent No.: US 10,816,009 B2
(45) Date of Patent: Oct. 27, 2020

(54) SEGMENTED FAN WHEEL

(71) Applicant: Ziehl-Abegg SE, Künzelsau (DE)

(72) Inventors: Frieder Lörcher, Braunsbach (DE); Andreas Gross, Neuenstein (DE); Georg Hofmann, Tauberbischofsheim (DE); Lothar Ernemann, Heilbronn (DE)

(73) Assignee: Ziehl-Abegg SE, Künzelsau (DE)

( * ) Notice: Subject to any disclaimer, the term of this patent is extended or adjusted under 35 U.S.C. 154(b) by 492 days.

(21) Appl. No.: 15/513,996

(22) PCT Filed: Sep. 24, 2015

(86) PCT No.: PCT/EP2015/001901
§ 371 (c)(1),
(2) Date: Mar. 24, 2017

(87) PCT Pub. No.: WO2016/045797
PCT Pub. Date: Mar. 31, 2016

(65) Prior Publication Data

US 2017/0335861 A1 Nov. 23, 2017

(30) Foreign Application Priority Data

Sep. 24, 2014 (DE) ..... 10 2014 014 287

(51) Int. Cl.
*F04D 29/32* (2006.01)
*F04D 29/38* (2006.01)
(Continued)

(52) U.S. Cl.
CPC ..... *F04D 29/326* (2013.01); *F04D 19/022* (2013.01); *F04D 29/282* (2013.01);
(Continued)

(58) Field of Classification Search
None
See application file for complete search history.

(56) References Cited

U.S. PATENT DOCUMENTS 1,873,974 A 8/1932 Meyer
5,141,397 A 8/1992 Sullivan
(Continued)

FOREIGN PATENT DOCUMENTS

CN 2705640 6/2005
DE 25 35 196 2/1977
(Continued)

*Primary Examiner* — Igor Kershteyn
*Assistant Examiner* — Juan G Flores
(74) *Attorney, Agent, or Firm* — Gudrun E. Huckett

(57) ABSTRACT

The invention relates to a fan wheel having blades (11) which are distributed over the circumference and are connected to one another in the circumferential direction via at least one ring. The fan wheel consists of at least three integrally formed segments (I to VII). Said segments comprise at least one respective ring portion (1) of at least one ring as well as either a blade (II) or at least a portion of the blades. The segments (I to VII) are joined together to form the fan wheel. The ring portions (1) lie against each other with edges (4, 5) which form the joining areas (15, 16) that are disposed transversely with respect to the circumferential direction of the fan wheel. At least one edge (4) of the ring portion (1) of each segment (I to VII) is provided with at least one projecting form-fitting part (18), and at least one edge (4, 5) of the ring portion (1) of each segment (I to VII) is provided with at least one recess (17) which is at least approximately complementary to the form-fitting part (18).

21 Claims, 21 Drawing Sheets

(51) Int. Cl.

| | |
|---|---|
| ***F04D 19/02*** | (2006.01) |
| ***F04D 29/28*** | (2006.01) |
| ***F04D 29/62*** | (2006.01) |

(52) U.S. Cl.
CPC ..... *F04D 29/384* (2013.01); *F04D 29/388* (2013.01); *F04D 29/626* (2013.01); *F05D 2230/51* (2013.01); *F05D 2260/36* (2013.01)

(56) References Cited

U.S. PATENT DOCUMENTS

| | | | | |
|---|---|---|---|---|
| 5,797,727 | A * | 8/1998 | Peters | F04D 17/164 416/204 R |
| 5,800,128 | A | 9/1998 | Bodmer et al. | |
| 9,127,562 | B2 * | 9/2015 | Raible | F01D 5/143 |
| 2003/0235502 | A1 | 12/2003 | Van Dine et al. | |
| 2009/0155080 | A1 | 6/2009 | Yu | |
| 2012/0230826 | A1 | 9/2012 | Raible | |

FOREIGN PATENT DOCUMENTS

| | | | | |
|---|---|---|---|---|
| DE | 2535196 | A1 * | 2/1977 | F04D 29/2222 |
| DE | 41 39 293 | | 6/1993 | |
| DE | 195 25 829 | | 1/1997 | |
| DE | 197 42 023 | | 3/1999 | |
| DE | 10 2009 008 508 | | 8/2010 | |
| DE | 10 2013 104 534 | | 11/2014 | |
| JP | H04-269399 | | 9/1992 | |
| JP | 2005-264842 | | 9/2005 | |
| JP | 2013-505385 | | 2/2013 | |
| RU | 2390658 | | 10/2009 | |
| RU | 2429385 | | 9/2011 | |
| WO | 2012/131617 | | 10/2012 | |
| WO | WO-2012131617 | A1 * | 10/2012 | B29C 70/86 |

* cited by examiner

SEGMENTED FAN WHEEL

BACKGROUND OF THE INVENTION

The invention concerns a fan wheel with vanes arranged in distribution about the circumference, which in circumferential direction are connected to each other by at least one ring, wherein the fan wheel is comprised of at least three segments each embodied as one piece that each have at least one ring segment of at least one ring as well as either a vane or at least a section of vanes and are joined to a fan wheel, in which at least the ring section/the ring sections are contacting each other by rims that are positioned transversely to the circumferential direction of the fan wheel and form joining areas.

Generally, fan wheels can be understood as radial fan wheels, diagonal fan wheels, axial fan wheels but also inlet or outlet guide wheels (stators) of fans.

Fan wheels are manufactured of different materials. For example, they can be produced from fiber reinforced plastic materials as one piece. Up to a certain outer diameter, such a fan wheel manufacture has been proven successful. For greater sizes, the required investment in injection molding tools as well as the price of parts due to the high machine units for large injection molding machines increases however so much that a realization is no longer cost-effective. Also, the cylinders of the injection molding machines in general are not capable of heating more than 15 kg of melted fiber reinforced plastic material to sufficiently high temperatures.

For this reason, it is also known to produce such fan wheels of several parts. For example, it is known (DE 41 39 293 A) to join end to end box-shaped or U-shaped segments with material fusion or form fit and to attach to the top side and the bottom side of these joined elements a hub ring as well as a cover ring by gluing or welding. As a result of the great number of individual parts, the manufacture of such impeller wheels is complex, time-consuming, and accordingly expensive because initially the segments must be joined end to end and in further steps the cover ring as well as the hub ring must be attached.

Fan wheels are also known in which the vanes are detachably connected to a hub with which the fan wheel is seated on a drive shaft (DE 10 2009 008 508 A1).

Furthermore, fan wheels are known (WO 20012/131 617 A1) in which the vanes are embodied in the form of hollow segments. They are joined end to end and subsequently held together by means of a disk and a cap which are fastened to the top side and to the bottom side of the assembled vane segments. Such fan wheels can be manufactured and assembled only with great expenditure. Initially, the vane segments must be joined and positioned. Only subsequently, the disk as well as the cap are placed onto the two sides of the assembled vane segments and connected to them.

Moreover, fan wheels are known (US 2003/0235502A) which are assembled of block-shaped segments. The block-shaped inner and outer parts that form cylindrical outer and inner rings are contacting each other with their axially extending faces. Such fan wheels have a high weight and are suitable only for special application situations.

The invention has the object to design the fan wheel of the aforementioned kind such that it can be produced inexpensively and in a simple way. In this context, the fan wheel should have only minimal weight and be able to withstand high loads, in particular high rotary speeds.

SUMMARY OF THE INVENTION

This object is solved for the fan wheel of the aforementioned kind in accordance with the invention in that at least one rim of a ring section of each segment is provided with at least one projecting form fit part and at least one rim of a ring section of each segment is provided with at least one recess that is approximately complementary to the form fit part.

In the fan wheel according to the invention, the joining areas are enlarged in their surface area by the projecting form fit part and the correlated recess so that the fan wheel assembled from the segments has a high stability and strength. A joining surface enlarging design differs from a conventional design in that the cross section through the joining areas does not have the shape of a straight connecting stretch that connects the two walls of the ring along a short path and extends approximately perpendicular to the walls. When the segments are connected to each other by means of an adhesive, due to the joining surface enlarging design the gluing surface is enlarged which leads to an increase of the strength of the fan wheel. This applies likewise when neighboring segments are areally welded at the joining areas to each other. In addition, due to this joining surface enlarging design, an additional form fit connection between neighboring segments is formed so that displacements of the segments relative to each other transverse to the circumferential direction are prevented. Also, with such a design, joining of the segments in the manufacturing process can be facilitated because the form fit parts form an additional guiding means of neighboring segments relative to each other. The form fit parts and the recesses form a tongue and groove connection that leads to a secure connection of the segments. Neighboring segments are joined during the manufacturing process axially or radially or in a mixed form of axial and radial so that the projecting form fit part reaches the recess of the respectively adjoining ring section of the neighboring segment. With the embodiment according to the invention, the joining surface is significantly increased without the wall thickness of the ring sections being enlarged. As a result of the embodiment according to the invention, the manufacturing process of the fan wheel according to the invention can be designed to be very economical, quick, and precise.

In the fan wheel according to the invention, segments that are embodied as one piece are used which comprise ring sections as well as vanes or vane sections. The ring sections extend substantially transverse to the vanes or vane sections and extend with a directional component in circumferential direction of the fan wheel. The rims of the ring sections which are positioned transversely to the circumferential direction of the fan wheel form the joining areas in the joined fan wheel. The segments that are contacting each other are connected at the joining areas in such a way with each other that, despite the minimal wall thickness of the ring sections, a sufficiently strong connection between the segments is possible. In the joined state, the ring sections of the segments as a whole form one or several rings. Rings can be in particular hub rings or cover rings which connect the vanes at their lateral ends with each other in circumferential direction, or intermediate rings which are connected with the vanes in their intermediate areas between their lateral ends. The hub ring serves advantageously for connecting the fan wheel with a drive motor. In case of stators, the cover ring serves advantageously for fastening the stator on another device.

Advantageously, the form fit part tapers in the direction toward its free end. In this way, joining of neighboring segments is significantly simplified.

In an advantageous embodiment, the recess is arranged in the area between the top side and the bottom side of the ring section. Advantageously, the recess and accordingly also the form fit part can be provided approximately at half the thickness of the ring section.

In another advantageous embodiment, the recess is open toward the top side or toward the bottom side of the ring section. Such an embodiment enables a simple and problem-free joining process when producing the fan wheel. Since the recess is open toward one side of the rim section, neighboring segments can be very easily joined end to end in axial direction of the fan wheel during manufacture.

In such a case, the rim of the ring sections comprising the form fit part as well as the recess is advantageously of a stepped embodiment. Such elements can be very easily manufactured with regard to manufacturing technology.

It is advantageous when the recess has a depth that amounts to approximately 0.7 to 2.5 times the wall thickness of the ring section.

In a preferred embodiment, the form fit part is resting with at least one of its side faces on the side wall of the recess. It is advantageous when the form fit part is resting with both side faces on the side walls of the recess. In this case, neighboring segments are securely and fixedly connected to each other.

In principle, it is however also possible that between the side faces and/or the end face of the form fit part and the side walls and/or the bottom of the recess a free space remains.

The spacing of the form fit part relative to the side walls and/or to the bottom of the recess produces the free space into which, for example, a viscous adhesive can be introduced. This adhesive can be introduced into recess prior to joining of the segments.

Advantageously, the transition of at least one side face of the form fit part into the rim of the ring section is curved, preferably at a radius which is approximately 0.05 to 0.3 times the wall thickness of the ring section. The transition is realized advantageously bionically, i.e., without constant radius. The bionic design has the advantage that the transition in regard to the force flow from the form fit part into the ring section of the respective segment can be designed such that a crack formation is reliably prevented. In this way, the transition can be matched optimally to the loads that are occurring in use of the fan wheel.

In an advantageous embodiment, the areas of the ring section between the side walls of the recess and the top side as well as bottom side of the ring section are approximately of the same thickness.

The ring section can however also be designed such that these areas between the side walls of the recess as well as the top side and the bottom side of the ring section have different thicknesses. In this case, the area which in use of the fan wheel does not contribute or contributes only little to the force transmission can be designed thinner than the oppositely positioned area.

In order to achieve a secure connection of neighboring segments without impairment of the strength of the fan wheel assembled from the segments, it is advantageous when one side face of the form fit part is greater than the oppositely positioned other side face.

In order to further enlarge the area which is transmitting the force upon joining of the segments to the fan wheel, the wall thickness of the ring section is advantageously greater in the recess than the wall thickness in the area outside of the recess.

The segments are at least approximately identically embodied. Preferably, all segments have the same shape so that for their manufacture only a single injection molding tool is required; this keeps the manufacturing costs low.

The cover ring sections, hub ring sections, and intermediate ring sections of neighboring segments are preferably embodied such that their rims positioned transversely to the circumferential direction are substantially congruently resting against each other and form paired joining areas, respectively, with which neighboring segments are contacting each other areally. In this way, a simple and still secure connection of the segments resting against each other is ensured.

These joining areas can be positioned in a plane which is defined by the fan wheel axis and a radial line. Depending on the situation of use and the requirement profile, the joining areas of neighboring segments can also be designed such that they are positioned at an angle relative to the respective plane defined by the fan wheel axis and the radial line. The angle can be between 0° and approximately 80° in this context.

Neighboring segments can be connected to each other at the joining areas by means of gluing and/or welding.

A particularly advantageous embodiment of the fan wheel resides in that the inflow side and outflow side ends of the vanes have a spacing relative to the joining areas of the fan wheel. In this case, exclusively the rims of the ring sections which are extending transversely to the circumferential direction of the fan wheel are serving as connecting surfaces.

However, it is also possible that additional joining areas between neighboring segments are extending through the vanes. In this case, the complete vanes are formed not until joining of the segments occurs. In this case, the butt joints of the vane sections also form joining areas which are provided in addition to the rims of the ring sections. In this way, the fixed connection between the segments can be improved.

The segments are advantageously injection molded parts that can be produced in a simple and inexpensive way.

Advantageously, thermoplastic materials are employed as material for the segments.

For increasing the strength of the segments and thus of the fan wheel, the thermoplastic materials contain reinforcement parts, preferably reinforcement fibers.

The reinforcement fibers have advantageously lengths of approximately 10μ to more than 15 mm, preferably lengths of approximately 200μ up to approximately 10 mm. Such reinforcement fibers can be easily worked into the plastic material and ensure a high strength.

As adhesives for connecting the segments with each other, for example, 1-component or 2-component adhesives or solvent systems are conceivable.

A further advantageous connecting possibility resides in connecting the segments by means of laser welding, induction welding or hot gas welding to each other.

In particular in case of great diameters of the fan wheel, an advantageous embodiment resides in that at least one reinforcement strap is wound about at least one ring of the fan wheel. It holds the segments additionally fixedly together so that the fan wheel can be used even at higher rotary speeds or other high loads.

The reinforcement strap can be made of thermoplastic material or thermosetting resin and advantageously can contain reinforcement parts, preferably reinforcement fibers.

As reinforcement fibers, advantageously glass, carbon, aramid, thermoplastic material or natural fibers are conceivable.

The reinforcement strap can be fastened simply on the circumference of one or more rings of the fan wheel, in particular by welding or gluing.

A further advantageous embodiment resides in attaching the reinforcement strap on the circumference of one or more rings of the fan wheel by winding on a curing thermosetting resin.

A particularly optimal embodiment results when the reinforcement strap is wound with pretension onto the fan wheel. The thus obtained fan wheel is characterized by a high strength. Such a fan wheel can be employed at high rotary limit speeds.

In an advantageous embodiment, the pretension of the reinforcement strap is in the range between approximately 10 N and approximately 10 kN, preferably between approximately 10 to 100 N per $mm^2$ cross sectional surface area of the strap.

A reliable fastening of the reinforcement strap on the fan wheel is ensured when the fan wheel for receiving the reinforcement strap is provided on the rings that are to be provided with reinforcement strap with a circumferentially extending groove. In it, the reinforcement strap can be arranged such that it cannot slip off the fan wheel.

The use of a reinforcement strap can also be advantageously employed when the fan wheel is embodied as one piece, i.e., is not made of segments.

The fan wheel according to the invention can be a radial, an axial or a diagonal fan wheel as well as an inlet guide wheel or outlet guide wheel (stator).

The subject matter of the invention not only results from the subject matter of the individual claims but also from the specifications and features disclosed in the drawings and the description. They are claimed as being important to the invention even if they are not subject matter of the claims in as much as they are novel individually or in combination relative to the prior art.

Further features of the invention result from the further claims, the description, and the drawings.

BRIEF DESCRIPTION OF THE DRAWINGS

The invention will be explained in more detail with the aid of some embodiments illustrated in the drawings. It is shown in.

Figure 7:
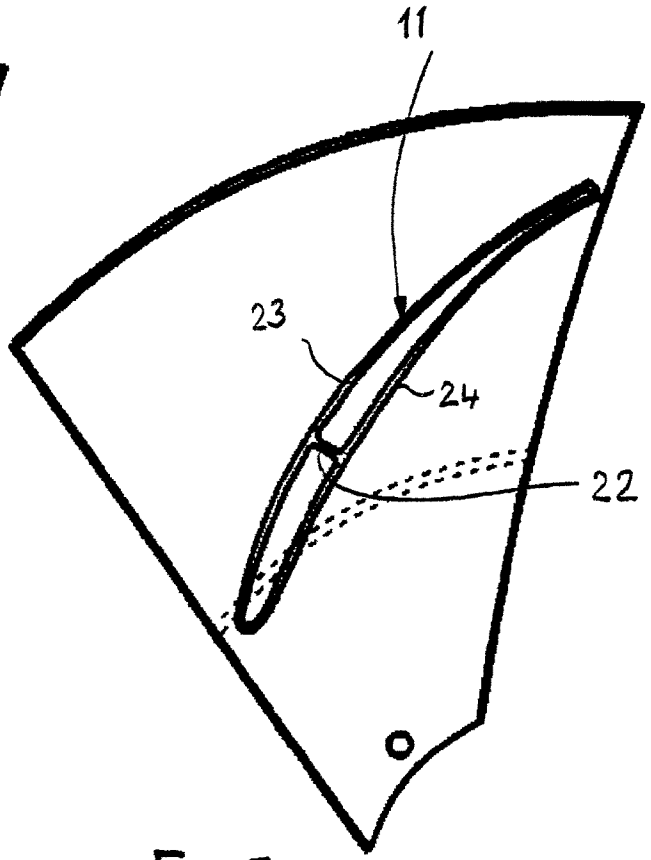

FIG. 7 respective further embodiments of segments for producing a fan wheel according to the invention.

FIG. 8 to

Figure 11:
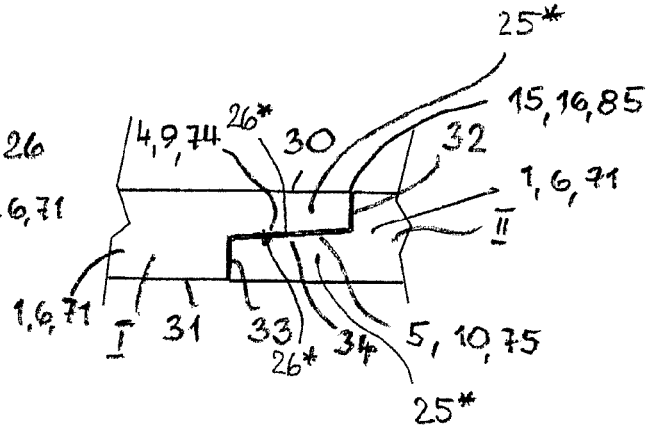

FIG. 11 in enlarged illustration, respectively, different embodiments of cross sections of joining areas of fan wheels according to the invention that are designed in a way to enlarge the joining surfaces.

Figure 12:
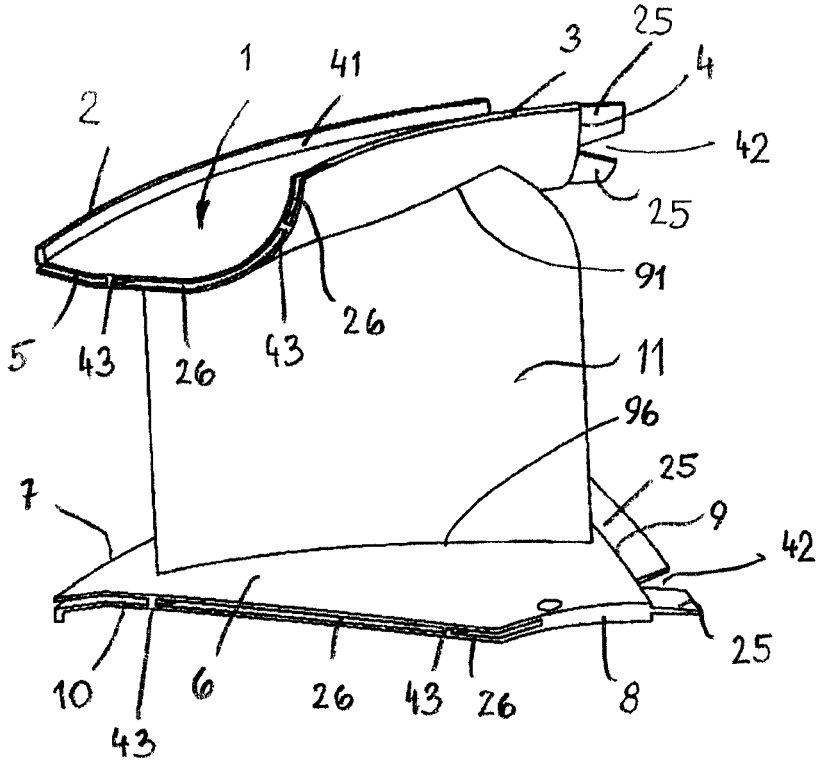

FIG. 12 in perspective illustration a further embodiment of a segment for producing a fan wheel according to the invention.

Figure 13:
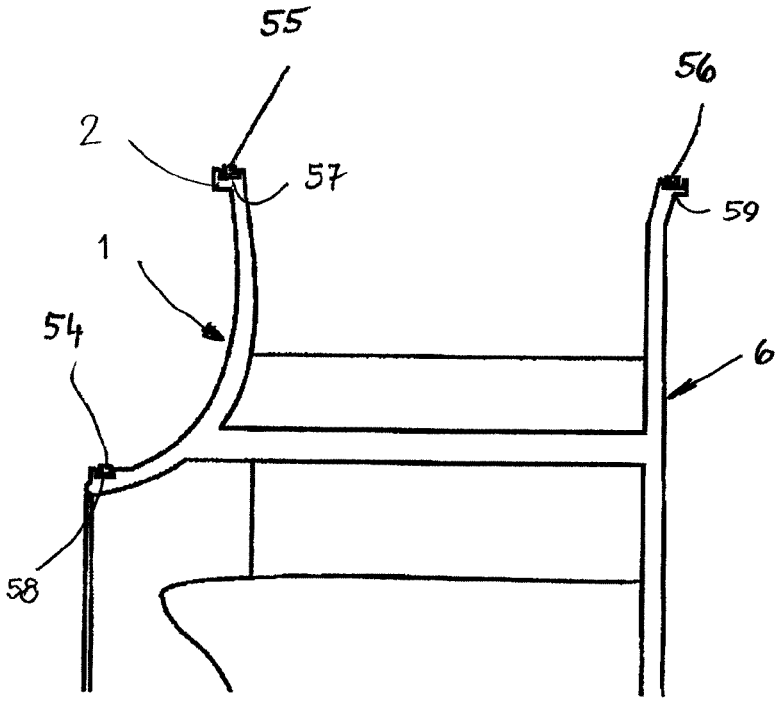

FIG. 13 in axial section one half of a further embodiment of a fan wheel according to the invention.

Figure 14:
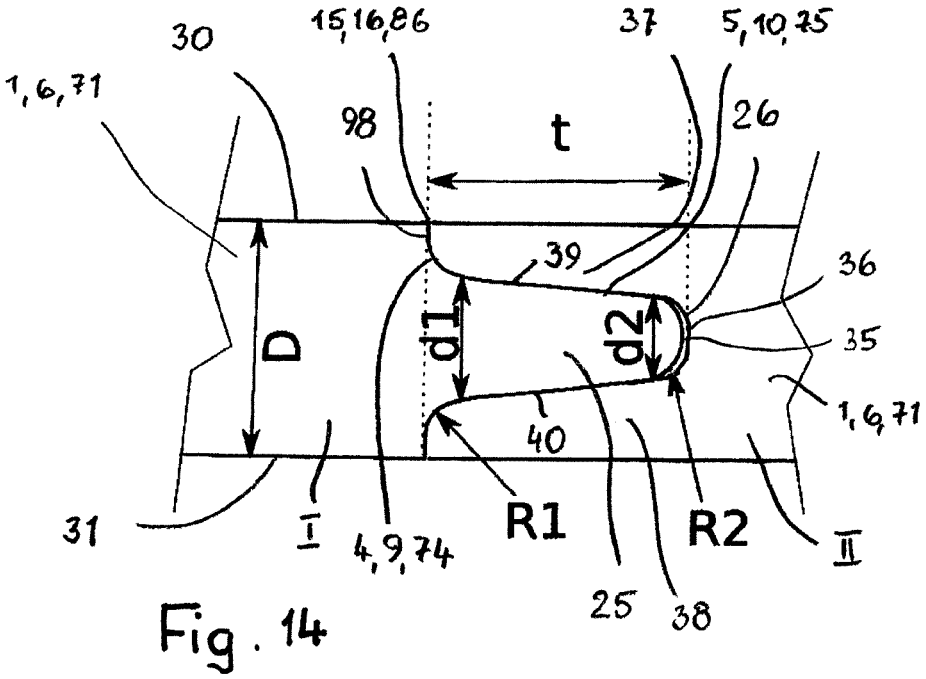

FIG. 14 in enlarged illustration an embodiment according to the invention of cross sections of joining areas between neighboring segments.

Figure 15:
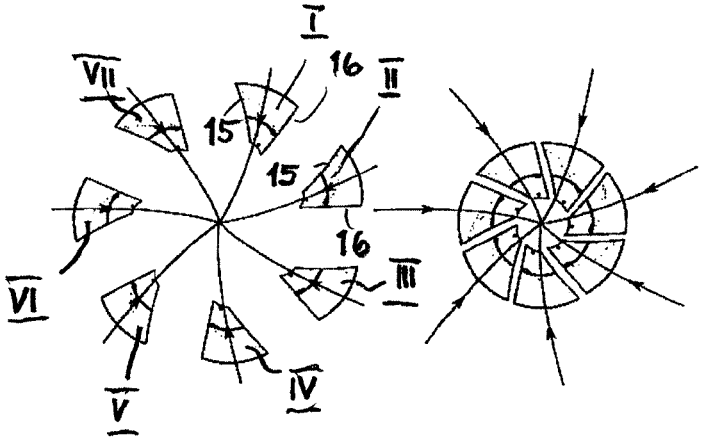

FIG. 15 in schematic illustration joining of the segments to a fan wheel according to the invention.

Figure 16:
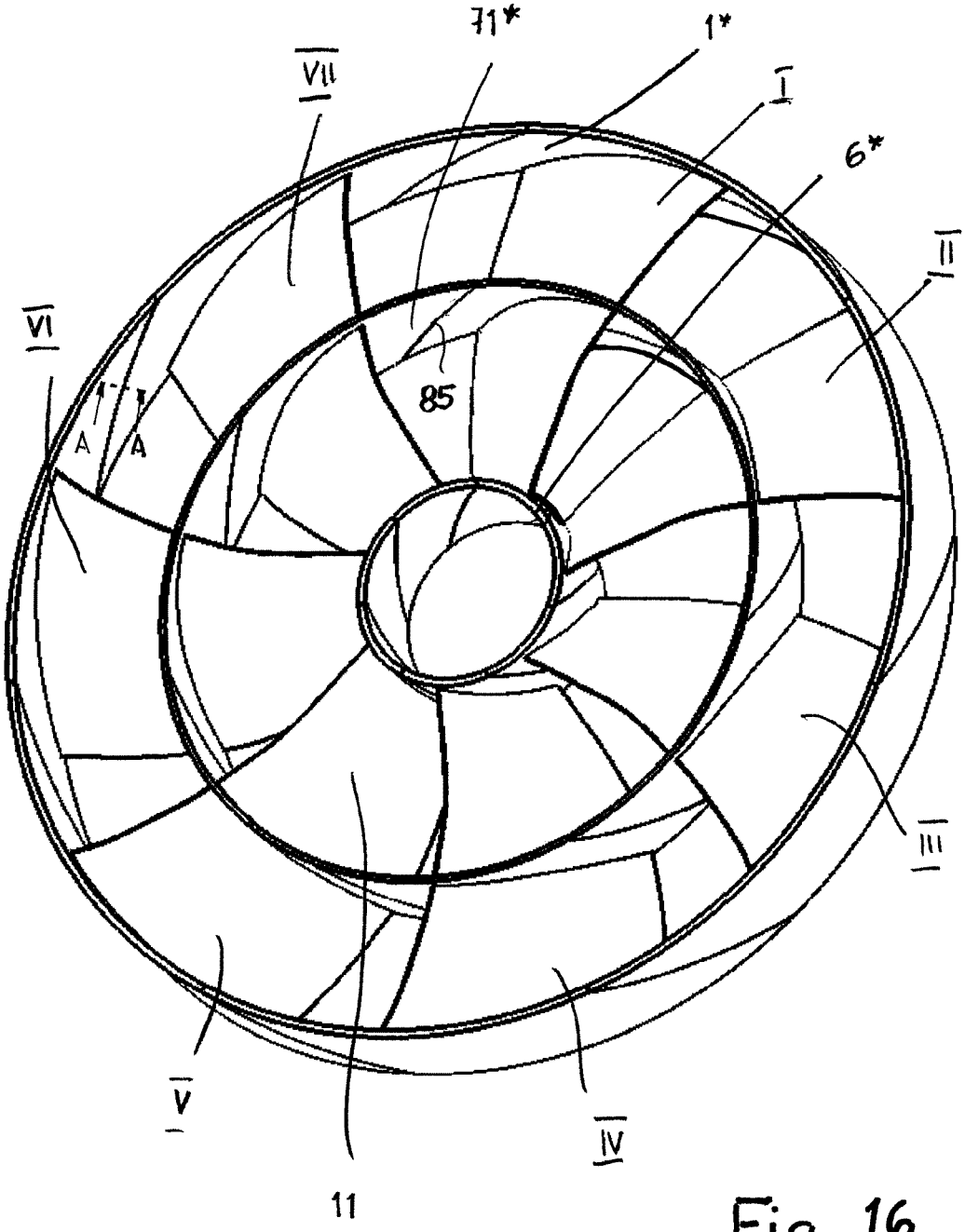
Figure 17:
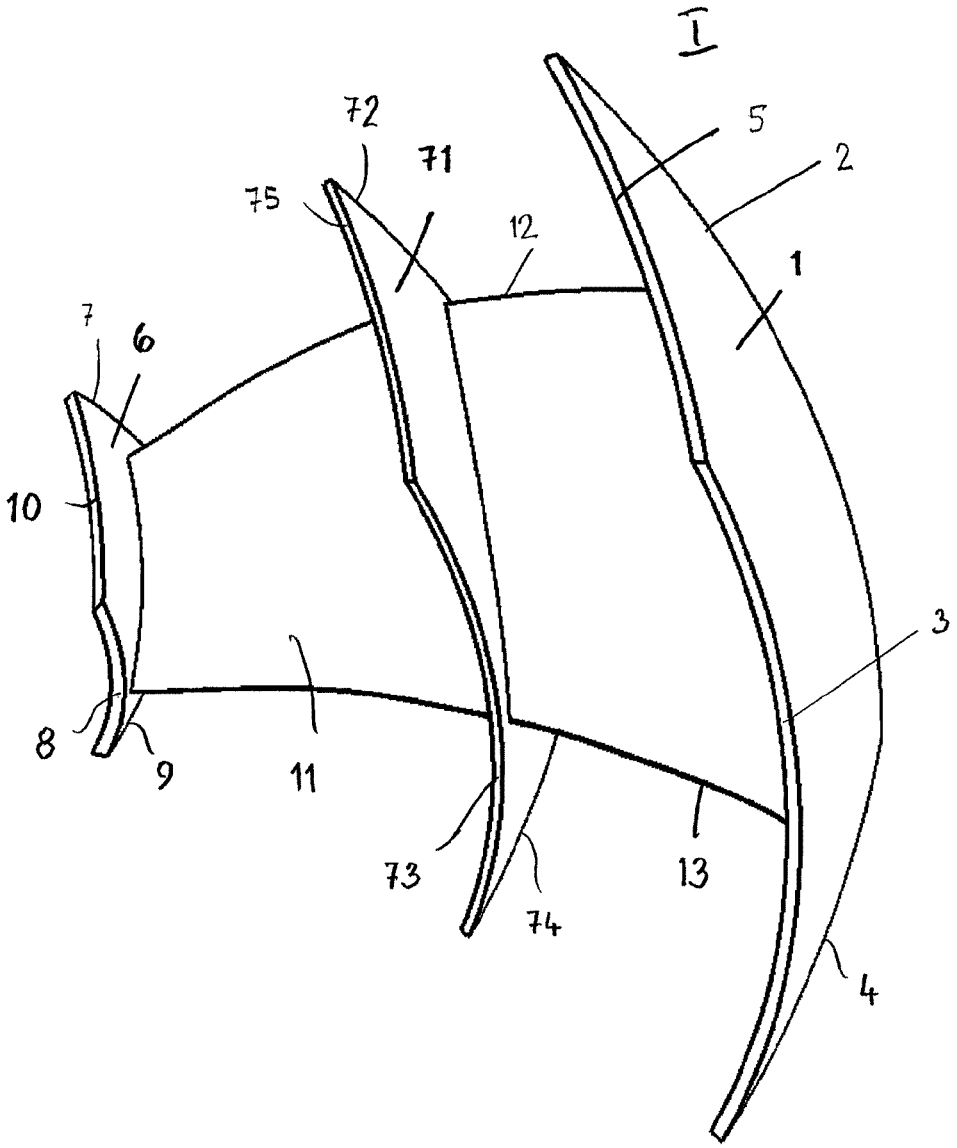

FIG. 16 in perspective illustration a further embodiment of a fan wheel according to the invention that is joined of 7 segments according to FIG. 17 and is an axial fan wheel with circumferentially extending cover ring as well as an intermediate ring.

FIG. 17 in perspective illustration a segment of a fan wheel according to FIG. 16.

Figure 18:
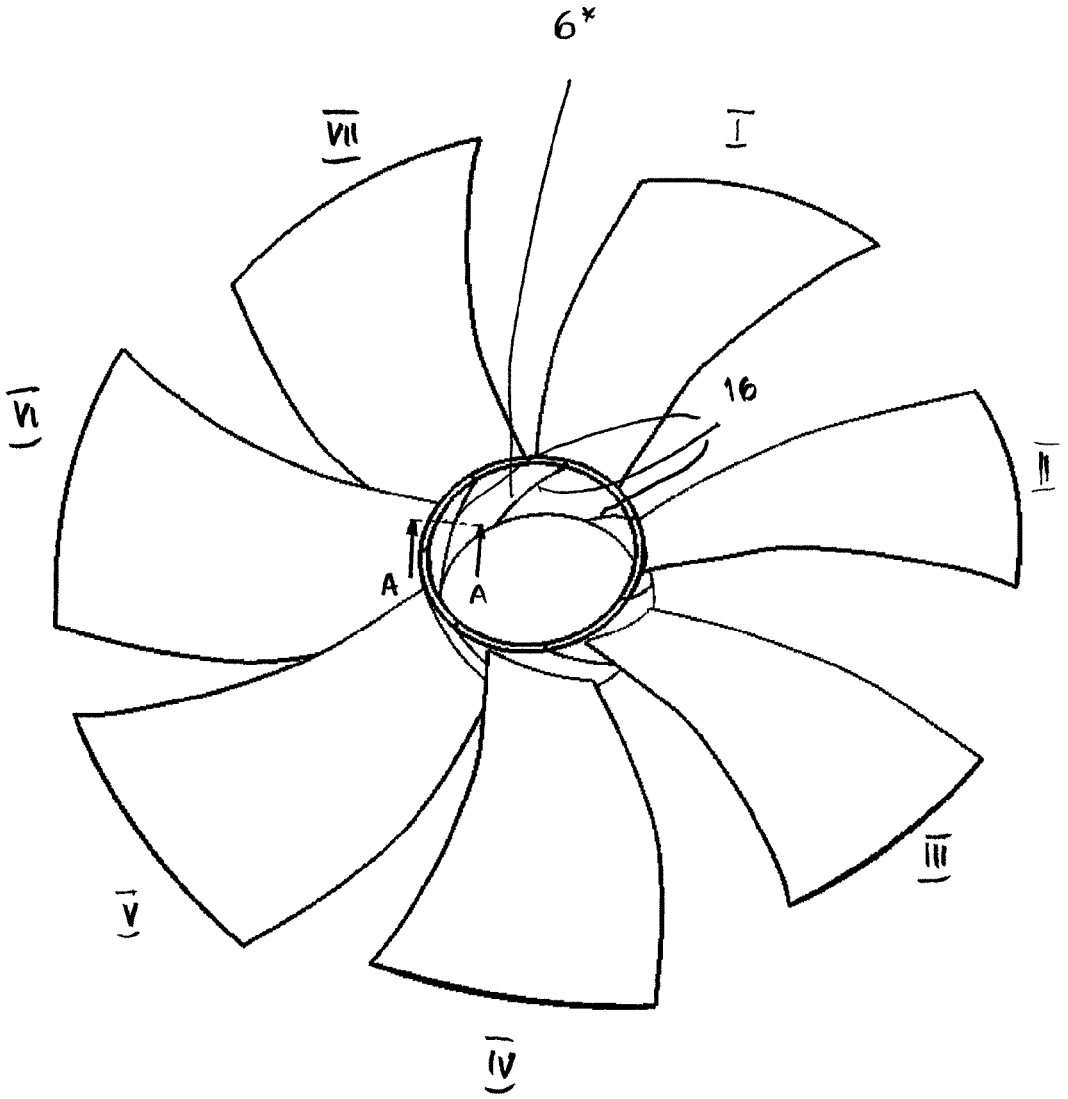
Figure 19:
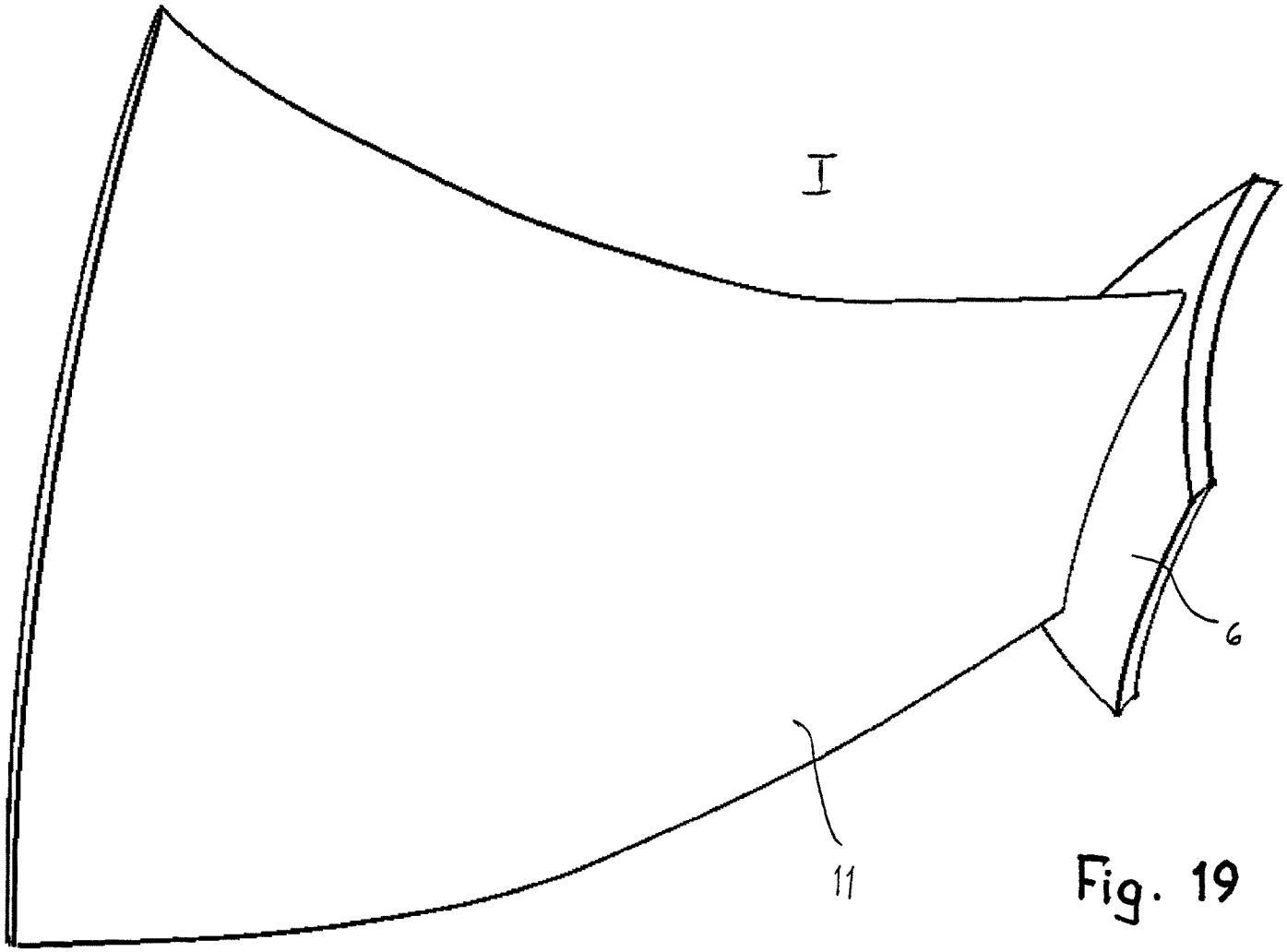

FIG. 18 in perspective illustration a further embodiment of a fan wheel according to the invention that is joined of 7 segments according to FIG. 19 and is an axial fan wheel without circumferentially extending cover ring.

FIG. 19 in perspective illustration a segment of a fan wheel according to FIG. 18.

Figure 20:
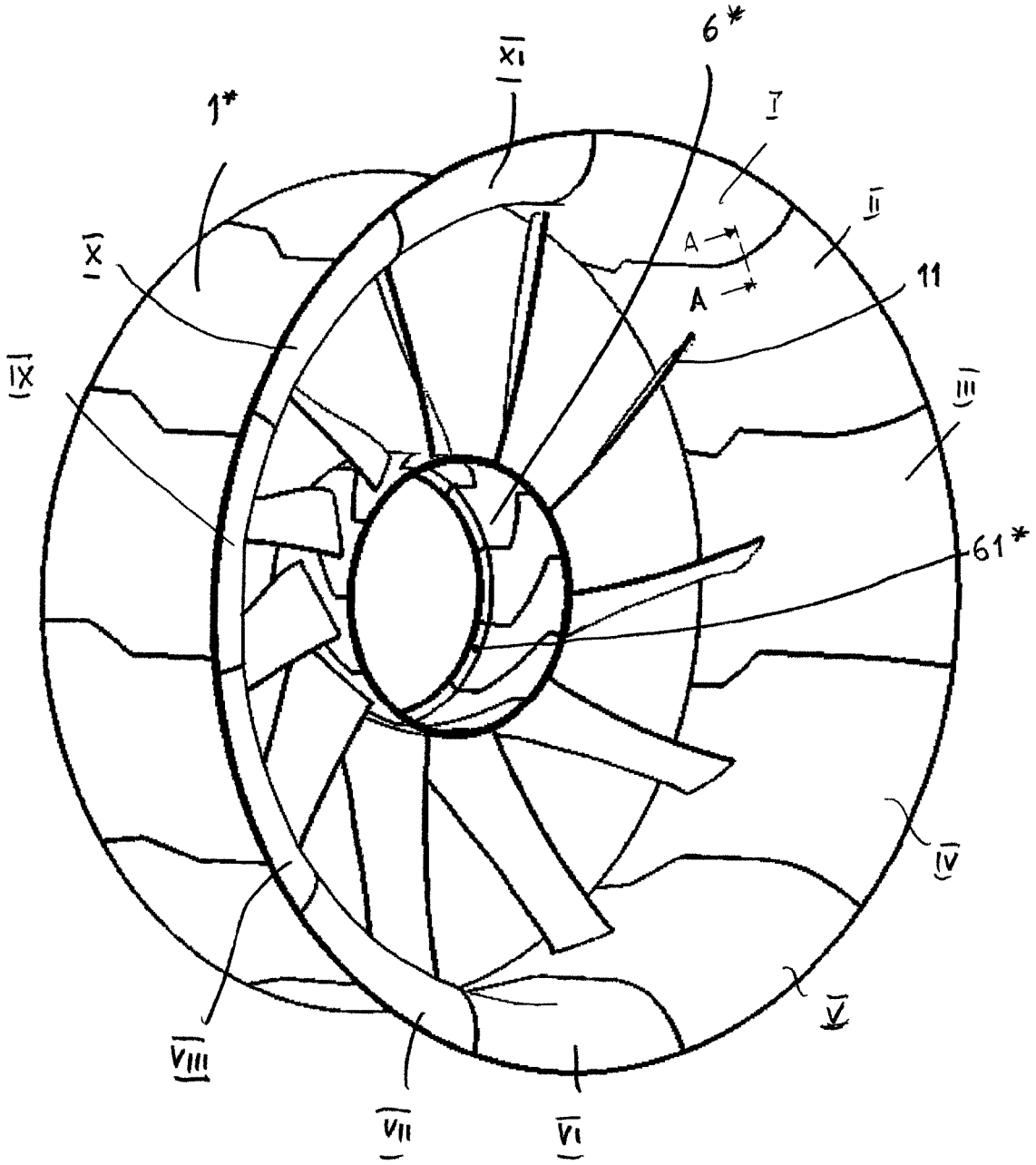
Figure 21:
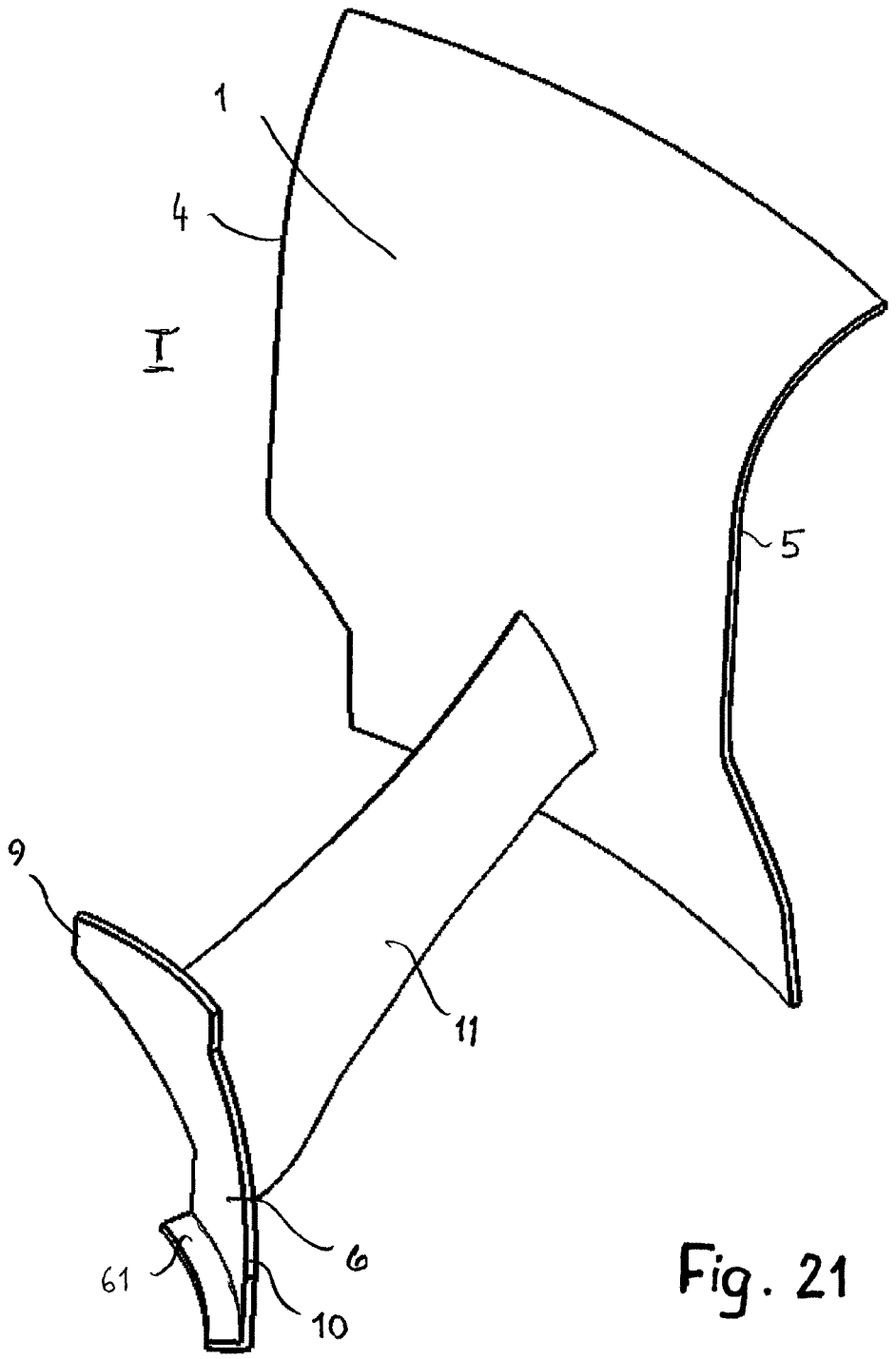

FIG. 20 in perspective illustration a further embodiment of a fan wheel according to the invention that is joined of 11 segments according to FIG. 21 and is an outlet guide wheel.

FIG. 21 in perspective illustration a segment of a fan wheel according to FIG. 20.

Figure 22:
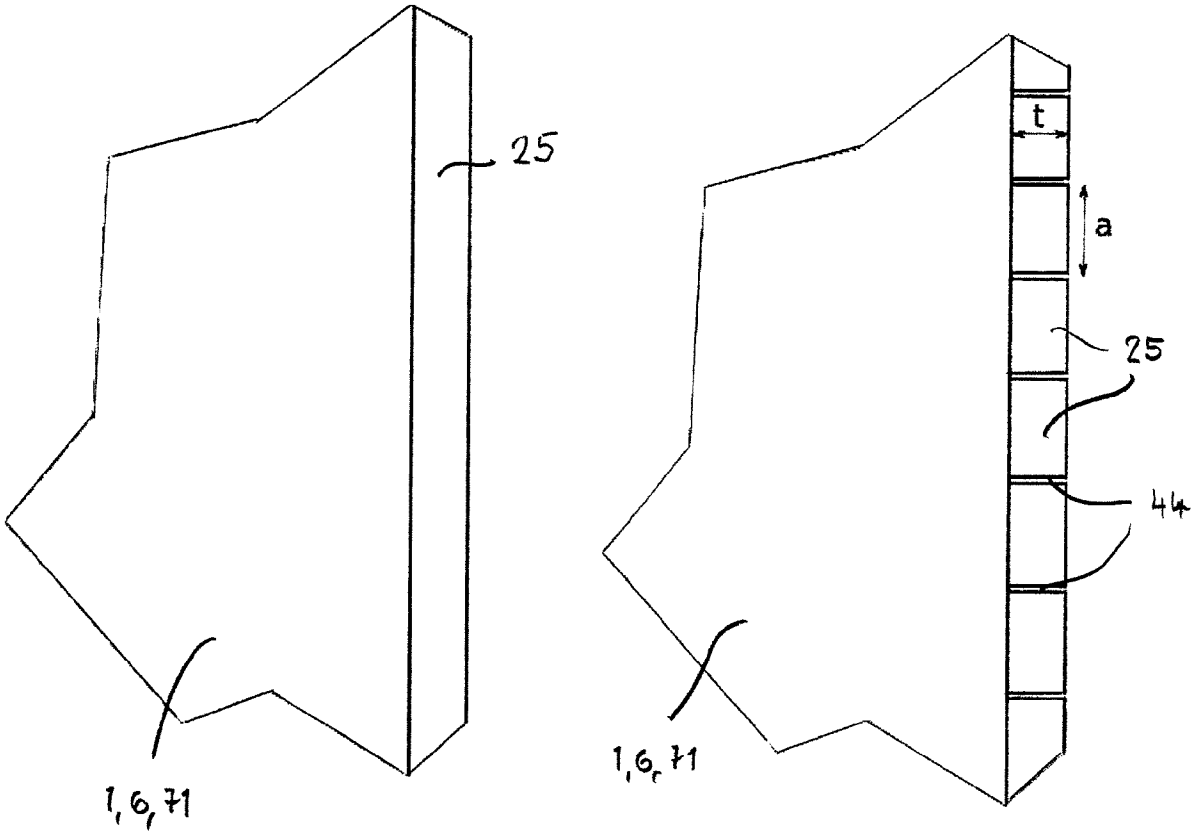

FIG. 22 details for configuring the segment rim in lateral plan view of a sector of the rim of a segment of an embodiment of a fan wheel according to the invention.

Figure 23:
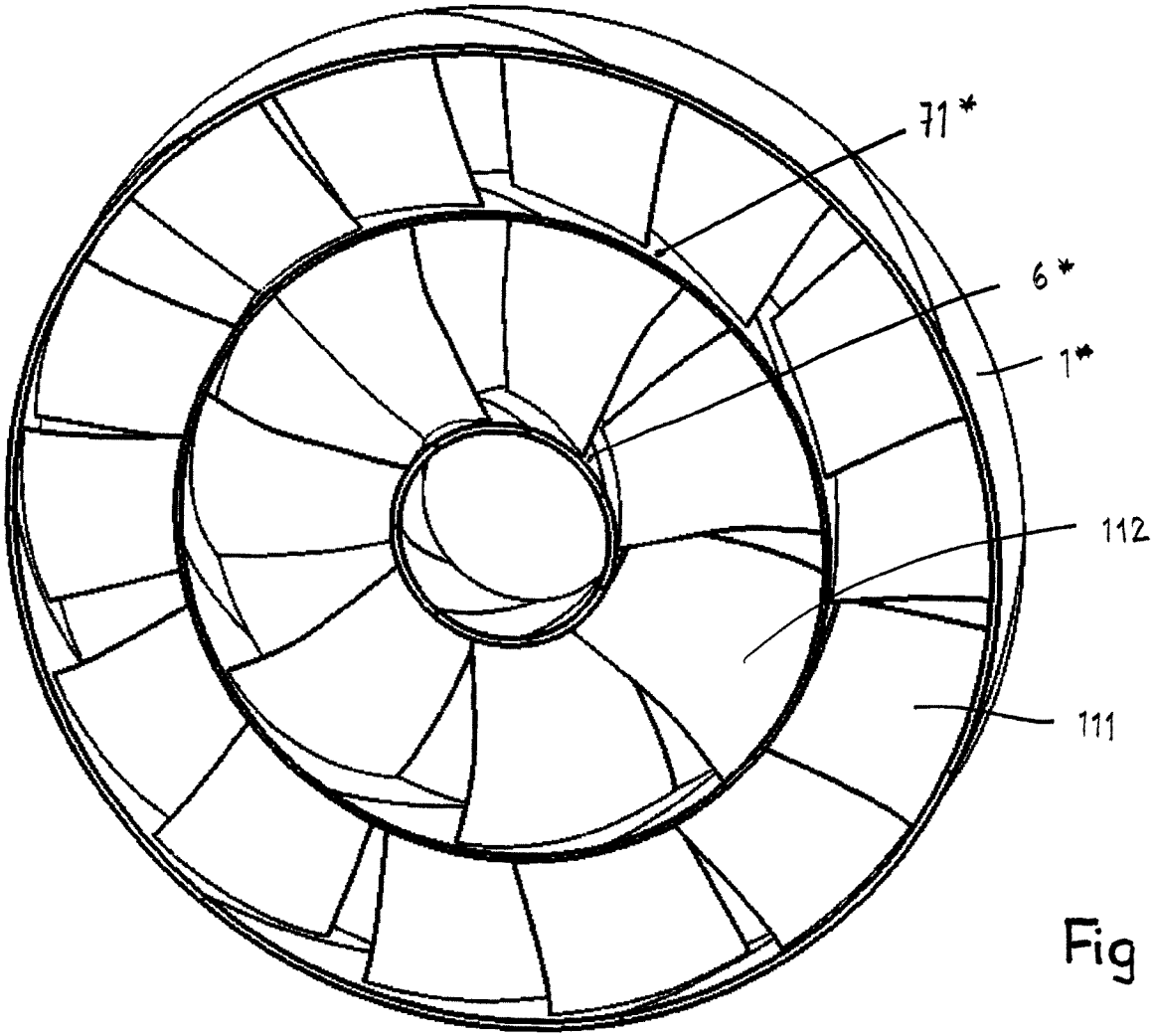
Figure 24:
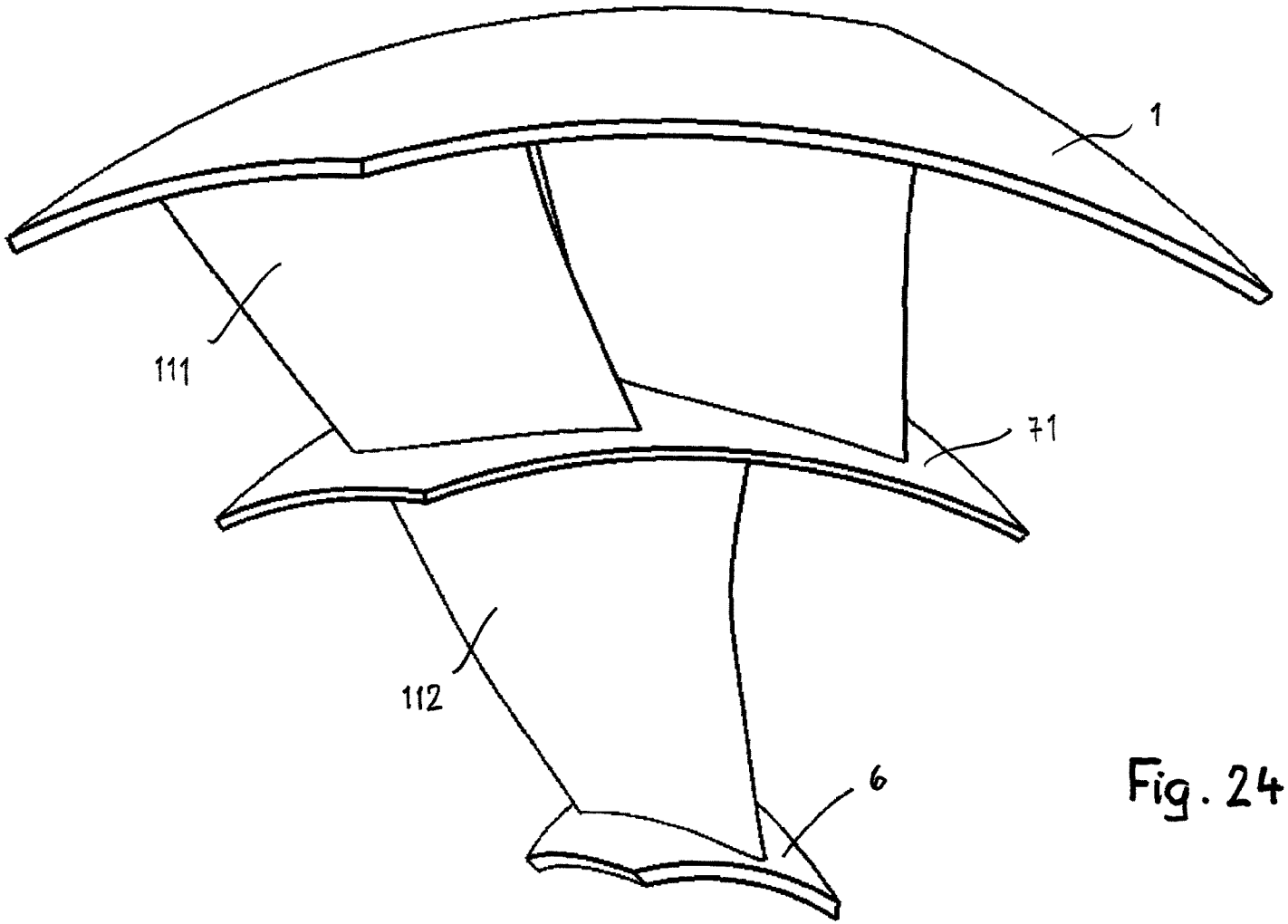

FIG. 23 in perspective illustration a further embodiment of a fan wheel according to the invention that is joined of 7 segments according to FIG. 24 and is an axial fan wheel with circumferentially extending cover ring as well as an intermediate ring, and in which the vanes between hub ring and intermediate ring and vanes between cover ring and intermediate ring differ in regard to shape and number.

FIG. 24 in perspective illustration a segment of the fan wheel according to FIG. 23.

Figure 25:
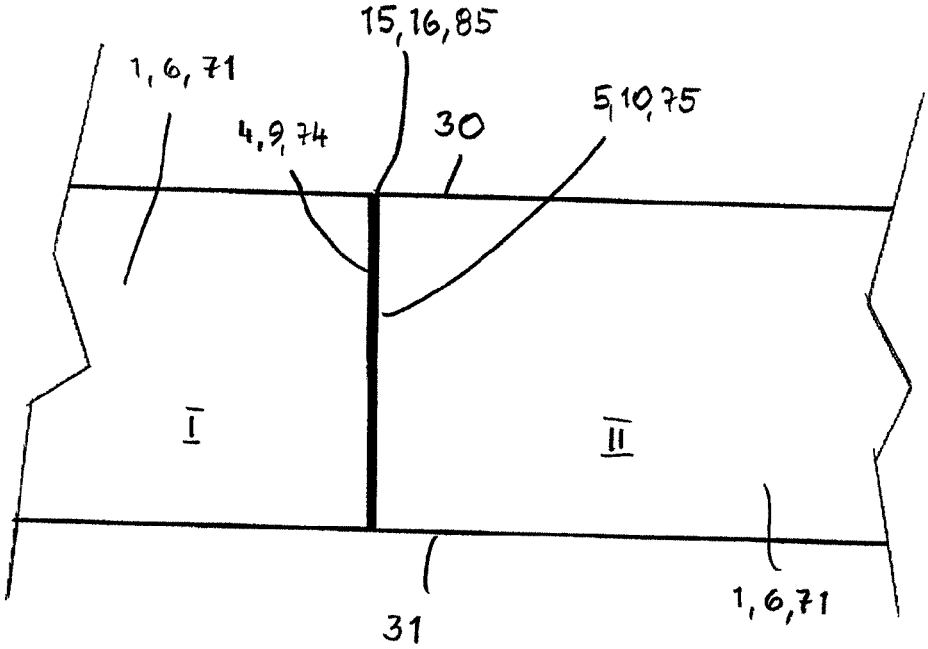

FIG. 25 in enlarged illustration an embodiment of a cross section of a joining area of fan wheels according to the invention which have no joining surface enlarging design.

Figure 26:
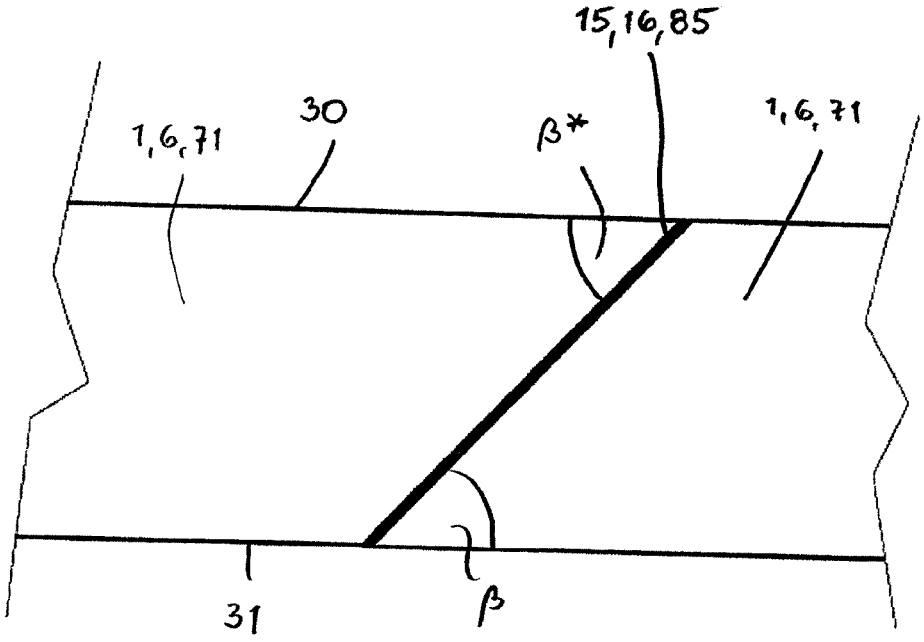

FIG. 26 in enlarged illustration and in cross section a further embodiment of the joining area of the fan wheel which is designed in a way to enlarge the joining surfaces.

Figure 27A:
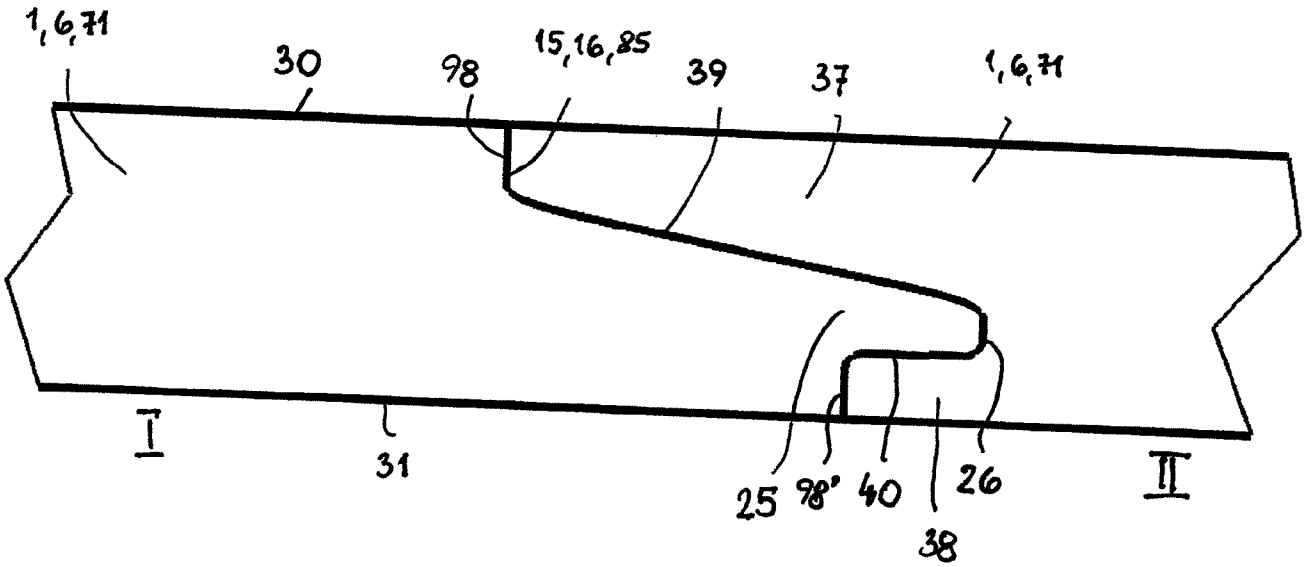

FIG. 27*a* in enlarged illustration an embodiment of a cross section of a joining area of fan wheels according to the invention which has a joining surface enlarging design in the form of an asymmetric tongue and groove connection.

Figure 27B:
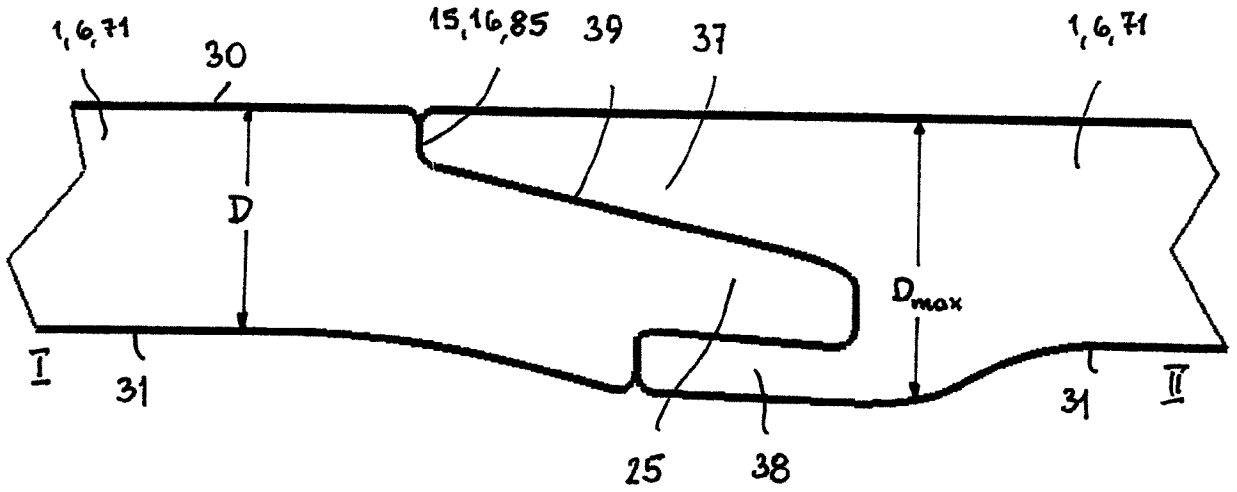

FIG. 27*b* in enlarged illustration an embodiment of a cross section of a joining area of fan wheels according to the invention, which has a joining surface enlarging design in the form of an asymmetric tongue and groove connection with locally thicker portion of the wall thickness.

DESCRIPTION OF PREFERRED EMBODIMENTS

In the following, fan wheels are disclosed that are made of plastic material and have in particular a large size and are suitable for high rotary speeds. Herein, fan wheels are understood to include stationary as well as rotating elements of fans with guiding function for a flowing medium which are substantially comprised of two to 40 vanes which are connected to each other by one, two or more rings in circumferential direction. Fan wheels can be, for example, radial fan wheels, diagonal fan wheels, axial fan wheels, but also inlet or outlet guide wheels (stators). The fan wheels are joined of segments that are substantially identical or at least similar relative to each other. In this way, expensive injection molding tools are not required. The manufacture of the fan wheel is cost-efficient. Despite the assembly of the fan wheels from individual segments, they have shape stability even at high rotary speeds. The segments, as will be explained with the aid of the following embodiments, are connected so strongly with each other that the assembled fan wheel withstands high loads, for example, rotary speed loads.

The number of segments of which a fan wheel according to the invention is comprised corresponds preferably to the number of fan wheel vanes. In particular in case of fan wheels with a high number of vanes, one segment may contain also two or more vanes so that the number of segments is reduced. For all segments of the fan wheel only one injection molding tool is required, in particular when the segments are of identical configuration relative to each other. When the segments are similar to each other, generally a single injection molding tool is also sufficient then. The different configuration features of the similar segments relative to each other can then be achieved either by exchangeable mold inserts in the injection molding tool or by postprocessing of some injection molded segments or of the joined fan wheel. The design of the segments and in particular of the vanes can be realized very flexibly because an injection molding tool for a segment, in comparison to an injection molding tool for a complete wheel, can be designed with significantly fewer limitations. For example, a complex split mechanism must often be used in an injection molding tool for producing a fan wheel as a complete molded part in order to be able to demould the vane channels; this is not required in an injection molding tool for producing a segment in advantageous embodiments. Accordingly, even hollow vanes for weight reduction can be designed in a simple way.

The individual segments are connected to each other by means of suitable joining methods for forming the respective fan wheel. As joining methods, inter alia adhesive methods, laser welding methods, friction welding methods, induction welding methods, hot gas welding methods or ultrasonic welding methods are preferably considered. The joining areas between the contacting segments can be selected relatively freely, taking into consideration the operating stresses to be expected when the fan wheel is in use. The connection between the segments can be produced by the disclosed joining methods alone. However, it is advantageous when in addition a form fit connection between the neighboring segments is existing that can serve for providing additional strength as well as for providing a guide during the manufacturing process.

Figure 2:
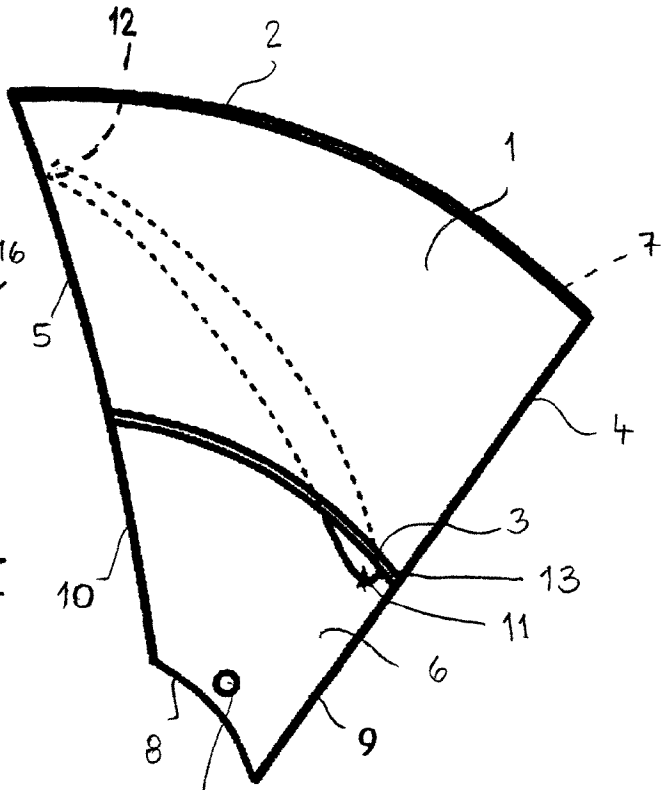
FIG. 2 in enlarged illustration a segment for producing the fan wheel according to FIG. 1.
Figure 1:
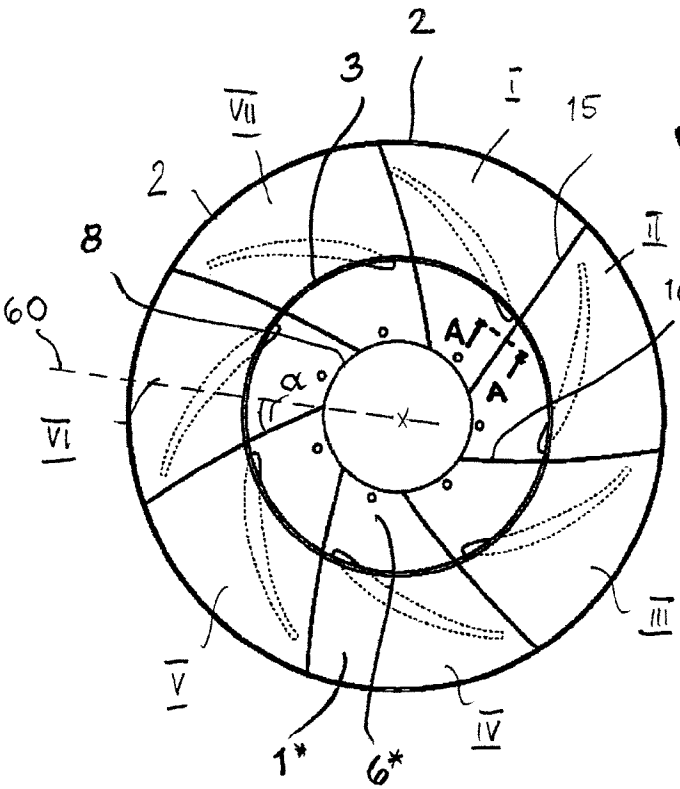
FIG. 1 in axial plan view a fan wheel according to the invention that is formed of several segments.

The fan wheel according to FIG. 1 is a radial fan wheel and is assembled of the segments I to VII. FIG. 2 shows one of these segments. Since in FIG. 2 the segment is illustrated only in plan view, in relation to the spatial design of the segment reference is being had to FIG. 12 that shows a different embodiment of the segment, but makes apparent the basic three-dimensional configuration of the segment. In the embodiment of FIG. 1, all segments I to VII are identical so that they can be produced in the same injection molding tool.

The segment has a cover ring section 1 that has a curved outer rim 2 as well as a curved rim 3 extending parallel thereto. Both ends of the rims 2, 3 are connected to each other by rims 4, 5. Viewed in axial plan view, the rim 4 is approximately adjoining at a right angle the outer rim 2. The oppositely positioned rim 5, viewed in axial plan view, adjoins at an acute angle relative to the outer rim 2. The rim 5 also adjoins at an obtuse angle and the rim 4 at an acute angle the inner rim 3 of the cover ring section 1. The cover ring section, as shown in FIG. 12, extends across its radial width in a curved shape such that the radial inner rim 3 has a greater axial spacing than the radial outer rim 2 from a hub ring section 6. The hub ring section 6 has also a radial outer rim 7 and a radial inner rim 8. Both rims 7, 8 are of a curved shape, respectively, and are connected to each other at their ends by rims 9, 10. The hub ring section 6 is projecting radially inwardly past the cover ring section 1. Viewed in axial plan view, the outer rim 7 of the hub ring section 6 is congruent to the outer rim 2 of the cover ring section 1. In other embodiments of fan wheels according to the invention, in particular diagonal or axial fan wheels, the outer rim 7 of the hub ring section 6, viewed in axial plan view, can also be positioned staggered and/or angular relative to the outer rim 2 of the cover ring section 1. The rims 9, 10 are positioned, viewed in axial plan view of the segment, across a portion of their length congruently to the rims 4, 5 of the cover ring section 1. This property enables a particular simple joining process. In other embodiments according to the invention, such a congruent configuration of the rims 9, 10 is not possible, for example, when the vane has a pronounced sickle shape or twisted shape.

Between the cover ring section 1 and the hub ring section 6, a vane 11 is extending which has a curved configuration across its length in the embodiment and has the profile of an airfoil in cross section. The vane 11 is connected with its end 91 associated with the cover ring to the cover ring section 1 and with its end 96 associated with the hub ring to the hub ring 6. The outflow side end 12 of the vane 11 extends approximately at an acute angle while the inflow side end 13, viewed in plan view, is rounded in an arc shape (FIG. 2).

The vane 11 extends with its outflow side end 12 close to the rim 5 of the cover ring section 1. With its inflow side end 13 the vane 11, viewed in axial plan view, is projecting past the cover ring section 1 and ends at a minimal spacing relative to the rim 9 of the area of the hub ring section 6 which is projecting past the cover ring section 1.

In deviation from the illustrated embodiment, the vane 11 can also have a different cross section configuration and/or a different extension. The vane 11 cannot only be curved across its length but in addition can also be of a twisted configuration across its length.

The hub ring section 6 comprises near its inner rim 8 at least one through opening 14. It is positioned advantageously approximately at half the width of the projecting hub ring section 6 and serves for passing fastening screws there through with which the fan wheel in a mounting position can be attached to a hub of a drive motor.

The hub ring section 6 can be of a planar configuration. However, it is also possible, as can be seen for example in FIG. 12, that the hub ring section 6 is angled or bent at the outer end. In other embodiments according to the invention, in particular diagonal wheels, the hub ring section 6 can also extend conically or curved across its entire extension or a part thereof.

In the state joined to a fan wheel (FIG. 1), the rims 4 and 5 of the respective cover ring sections as well as the rims 9 and 10 of the respective hub ring sections of respectively neighboring segments are adjoined. With regard to the entire fan wheel, pairs of adjoined rims 4 and 5 form joining areas 15 (at the cover side) and pairs of adjoined rims 9 and 10 joining areas 16 (at the hub side). In order to ensure a gap-free adjoined position of the rims 4 and 5 as well as 9 and 10 joining areas 15, respectively, 16, the curvature courses of the rims 4 and 5 as well as of the rims 9 and 10 of the respective neighboring segments must be substantially identical. The joining areas 15 and 16 extend transversely to the circumferential direction. In the illustrated embodiment of a radial fan wheel, the joining areas 15 and 16 extend also transversely to the axis of the fan wheel. Since the vane 11 ends at a spacing relative to these joining areas 15, 16, no additional burrs, edges and the like are produced on the vane 11 as a result of the manufacture from segments. The cover ring section 1 of the segments I to VII form in the joined fan wheel the entire cover ring 1*; correspondingly, the hub ring sections 6 of the segments Ito VII form together the hub ring 6*.

The fan wheel which is illustrated in perspective view in FIG. 16, is an axial fan wheel with cover ring 1*, hub ring 6*, as well as an intermediate ring 71* and is also assembled of segments Ito VII. In regard to the important features that mainly characterize the invention, the construction from segments is identical to that of the radial fan wheel according to FIG. 1.

FIG. 17 shows one of the segments of the axial fan wheel which is illustrated in FIG. 16 in which all segments I to VII are identical so that they can be produced in the same injection molding tool.

The segment I that is illustrated in FIG. 17 has a cover ring section 1 that has a curved rim 2 which is positioned downstream with regard to the main flow direction of the axial ventilator as well as a rim 3 which is extending parallel thereto and is displaced axially upstream. Both ends of the rims 2, 3 are connected to each other by rims 4, 5. The hub ring section 6 has also a downstream positioned rim 7 and an upstream positioned rim 8. Both rims 7, 8 are each of a curved configuration and are connected to each other at their ends by rims 9, 10. The hub ring section 6 is positioned radially completely within the cover ring section 1. The axial extension of the hub ring 6* and cover ring 1* is identical in the illustrated embodiment but can also be different, depending on the vane geometry, in other embodiments of axial fan wheels.

Viewed in radial direction, there is also an intermediate ring 71* between cover ring 1* and hub ring 6* in the embodiment according to FIG. 16. Such an intermediate ring provides even higher strength of the joined fan wheel. In an advantageous configuration, advantages in regard to the air flow rate, the efficiency, and the acoustics of the fan can be achieved also with an intermediate ring. One or more intermediate rings 71* can be present in all types of fan wheels, such as radial fans, diagonal fans, or inlet or outlet guide wheels. Due to the manufacture from segments, the realization of intermediate rings is possible with less expenditure with regard to tool construction in comparison to a manufacture as a complete molded part.

The segment I that is illustrated in FIG. 17 has accordingly an intermediate ring section 71 that has a rim 72 positioned downstream relative to the main flow direction of the axial ventilator as well as a rim 73 extending parallel thereto and displaced axially upstream. Both ends of the rims 72, 73 are connected to each other by rims 74, 75.

In the joined fan wheel, the rims 74, 75 of the intermediate ring section 71 of the respective segments form joining areas 85 (FIG. 16) that extend transversely to the circumferential direction of the fan wheel and by means of which neighboring segments I to VII are contacting each other. Since the vane 11 ends at a spacing relative to this joining areas 85, no additional burrs, edges and the like are produced on the vane 11 as a result of the intermediate ring 71*. The intermediate ring sections 71 of the segments I to VII form the complete intermediate ring 71* in the joined fan wheel.

Between the cover ring section 1 and the hub ring section 6, a vane 11 is extending which, in the embodiment of FIG. 16 with segments according to FIG. 17, is curved across its length and twisted and in cross section has the profile of an airfoil. The end 12 of the vane 11 positioned at the outflow side tapers, as in the preceding embodiment, approximately at an acute angle while the end 13 at the inflow side, viewed in cross section of the vane 11, is rounded with an arc shape, as is illustrated in the embodiment according to FIG. 2.

The vane 11 of the embodiment with segments according to FIG. 17 extends with its downstream end 12 close to the rim 2 of the cover ring section 1. With its upstream positioned end 13 the vane 11 is extending close to the rim 3 of the cover ring section 1.

In deviation from the illustrated embodiment, the vane 11 can also have another cross section configuration and/or a different extension.

In the fan wheel segment I according to FIG. 17, the hub ring section 6 has no device that serves for fastening the fan wheel on a motor. The fan wheel according to FIG. 16 which is formed of such segments can be fastened by press fit, clamping, gluing, welding or the like on a motor. Of course, in other embodiments of axial fan wheel segments holes or the like can be provided that later on then serve for fastening the fan wheel on a motor.

The hub ring section 6, the cover ring section 1, as well as the intermediate ring section 71 can be cylindrically embodied, in particular in case of an axial fan wheel. However, it is likewise possible, similar to what is illustrated in the embodiment according to FIG. 20 with the aid of the cover ring 1*, that the hub ring section 6 and/or the cover ring section 1 and/or the intermediate ring section 71 extends ao as to follow a complex three-dimensional contour which in particular can be better adapted to the flow conditions.

In FIG. 23, an axial fan wheel according to the invention is illustrated which is comprised of segments according to FIG. 24. In this embodiment with hub ring 6*, cover ring 1*, and intermediate ring 71*, vanes 111 are extending between cover ring 1* and intermediate ring 71* which in regard to shape and/or position and/or number differ from vanes 112 that extend between intermediate ring 71* and hub ring 6*. In this way, in embodiments with an intermediate ring the number of vanes and the vane geometry can be better adapted to the respective flow conditions. In embodiments with several intermediate rings 71*, more variability in regard to the configuration of the vanes can be accordingly provided.

The segment illustrated in FIG. 24 of the axial fan wheel according to FIG. 23 comprises the cover ring section 1, the intermediate ring section 21, and the hub ring section 6, from which the cover ring 1*, the intermediate ring 71*, and the hub ring 6* are produced. This segment has two vanes 111, which connect the cover ring section 1 with the intermediate section 71, and a vane 112, which connects the intermediate ring section 71 with the hub ring section 6.

The embodiment of an axial fan wheel, which is illustrated in perspective view in FIG. 18, is an axial fan wheel without cover ring and without intermediate ring and is also assembled of segments I to VII that are identical relative to each other and of which the segment I is illustrated in FIG. 19. The construction of the segments is similar to the construction of the already described embodiment according to FIG. 16. However, this axial fan wheel has no cover ring as is often conventional in axial ventilators in order to save weight and in order to reduce the flow resistance. Therefore, as joining areas only the joining areas 16 at the hub ring 6* remain which in this embodiment must absorb a higher load. The segment I has the hub ring section 6 and the vane 11.

The embodiment according to FIG. 20 with the segments according to FIG. 21 is a fan wheel (stator) which is stationary in operation. Stators can be inlet or outlet guide wheels in a fan. With regard to the construction of segments, no significant differences result however. In many application situations, stators are also highly loaded parts to which the ventilator with its motor is fastened and which are in particular loaded due to the oscillations and vibrations of the ventilator in operation. The stator according to FIG. 20 is constructed of 11 identical segments I to XI according to FIG. 21 in the manner of the invention. The rims 4, 5, 9, 10 of the cover and hub ring sections 1, 6 which are extending mainly in axial direction have a more complex course that has inner edges and corners. At the outflow side, the hub ring 6* is provided also with a planar flange 61* which is formed by flange sections 61 of the segments Ito XI and where later on the fan motor can be fastened. Bores are not yet provided in the segments because in the embodiment a stator is constructed of 11 segments; this would mean too large a number of holes. In this embodiment, the holes can be drilled in the flange 61* after joining.

In particular in case of a great number of vanes 11, it is also conceivable to provide in one segment more than one vane, for example, 2-4, which leads to a reduced number of segments. However, the injection molding tool for producing a segment then becomes more complex. Also, the number of vanes 11, in case of wanting exclusively identical segments, must be divisible by the number of vanes per segments.

Possibly, depending on the loads to be expected in operation, it may be advantageous to provide the fan wheels according to the invention with further intermediate rings 71* in circumferential direction, in addition to the cover and hub rings 1*, 6*. One or several such additional rings can be located in the area between cover ring 1* and hub ring 6*. Their configuration with rims in the segments and joining areas in the assembled wheel is equivalent to the configuration of cover and hub rings 1*, 6* according to the described embodiments. Intermediate rings 71* can provide additional stability but can also affect the flow positively (efficiency, acoustics). Such additional intermediate rings 71* can also be realized with comparatively minimal expenditure due to the manufacturing principle of segments.

For producing an advantageous embodiment of a fan wheel according to the invention, the segments Ito VII are first arranged in a star shape (FIG. 15) and then approximately radially pushed together in inward direction until the segments Ito VII with their rims 4 and 5; 9 and 10; 74 and 75 are contacting each other. At the resulting joining areas 15, 16, 85, the segments Ito VII are then fixedly connected to each other in the described way, for example, glued or welded. In this context, advantageously during the gluing or welding process a high pressure is exerted onto the segments Ito VII or onto the joining areas 15, 16, 85 so that the contacting segments Ito VII are connected fixedly to each other. In a similar way, the fan wheels that have more than seven segments are produced also. The segments can be produced in simple injection molding tools so that the manufacturing costs can be kept low. As material for the segments I to VII, the known materials conventional for injection molding of fan wheels are considered. Examples are short fiber reinforced or long fiber reinforced thermoplastic materials such as polyamide (PA6, PA66, PA66/6, PAPA, PPA, PA 4.6, PA 12) or polyester (PBT, PET), polypropylene (PP), PPS, PES, PESU, PEEK, ABS, PC, ASA. Preferably, polyamide, polypropylene or polyester is used as materials for the segments.

As reinforcement fibers for these materials, for example, glass, carbon, aramid, thermoplastic material (PET, PA) or natural fibers are conceivable, for example, flax, hemp, sisal, jute, or coconut fiber.

In embodiments in which neighboring segments are connected by means of laser welding, a high transparency of the employed plastic material for the employed laser light is required. In order to achieve this, as a polymer a plastic material that is highly transparent for the wavelength of the laser light is employed. This can be achieved by special color pigments in the plastic material. Furthermore, advantageously special reinforcement fibers (in particular, glass fibers) are used which have no or only minimal light refraction at the transition polymer to reinforcement fiber. This is possible by use of a special bonding agent coating on the surface of the glass fibers.

Excellent strengths for the segments and thus for the fan wheel result when the reinforcement fibers in the injection molded segment I to VII have lengths of approximately 50 μm to more than 15 mm. A preferred range is between approximately 200 μm and 10 mm.

When the segments Ito VII are glued together at the joining areas 15, 16, 85, 1-component or 2-component adhesives can be employed for this purpose, such as polyurethane, acrylic, methacrylates or silicones. For gluing, also solvent systems can be employed.

When the segments Ito VII are laser welded to each other at the joining areas 15, 16, 85, advantageously diode lasers, CO2 lasers or NdYAG lasers can be employed for this purpose.

The connection of the segments I to VII at the joining areas 15, 16, 85 can also be produced by friction welding, vibration welding or ultrasonic welding.

The connection of the segments Ito VII at the joining areas 15, 16, 85 can also be carried out by means of induction welding or hot gas welding. As hot gas, air, nitrogen or CO2 is conceivable, for example.

In both cases, the plastic material is softened in the area of the joining areas 15, 16, 85. Under the pressure at which the segments I to VII are pressed against each other at the joining areas 15, 16, 85, a material fusion connection of neighboring segments is thus realized thereby and, after cooling of the joining areas, leads to a secure connection of the segments.

Since the vane 11 and the ring sections 1, 6, 71 are embodied together as one piece and form the segment, a simple, fast, inexpensive manufacture of the fan wheel is possible.

Figure 3:
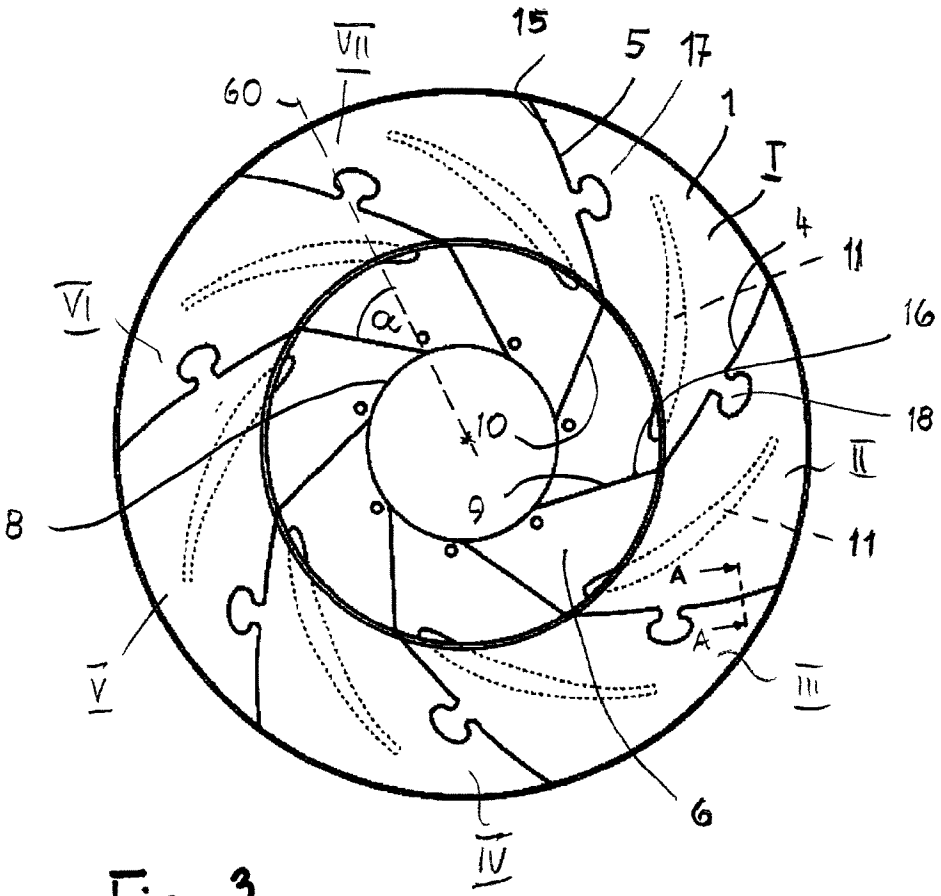
FIG. 3 an axial plan view of a second embodiment of a fan wheel according to the invention that is assembled of several segments.

The fan wheel according to FIG. 3 is similarly embodied as the fan wheel according to FIG. 1 and is comprised of the segments I to VII. The vanes 11 of the fan wheel are again arranged such that the joining areas 15, 16 are extending at a distance away from the vanes 11. In this way, the formation of burrs, edges or the like on the vanes 11 is prevented so that complex postprocessing is not required. While in the embodiment according to FIGS. 1 and 2 the segments I to VII with regard to loads that are acting in circumferential direction are connected to each other exclusively by material fusion or by an adhesive connection, the segments Ito VII in the embodiment according to FIG. 3 are additionally also connected to each other with form fit relative to such loads. This form fit is provided in the area of the rims 4, 5 of the cover ring sections 1 or the rims 9, 10 of the hub ring sections 6 of the segments Ito V. The areas of hub ring sections 6 that are radially inwardly projecting past the cover ring sections 1 are identically configured as in the embodiment of FIG. 1. The form fit between neighboring segments I to VII is designed such that the segments in circumferential direction cannot be detached from each other. Detachment of the segments from each other in the not yet glued or not yet welded state is possible only in that neighboring segments are displaced relative to each other in axial direction of the fan wheel.

On the rim 5 of the cover ring section 1 as well as on the area of the rim 10 of the hub ring section 6 positioned underneath in a view in axial direction, a cutout 17 with a contour that is approximately mushroom-shaped is provided, respectively. The oppositely positioned rim 4 of the cover ring section 1 as well as the area of the rim 9 of the hub ring section 6 positioned underneath in a view in axial direction are provided with a projecting mushroom-shaped projection 18 engaging the cutout 17 of the neighboring segment. The cutouts 17 and the projections 18 are designed complementary to each other so that they are resting with their rims against each other. Due to the mushroom shape configuration, the cutouts 17 as well as the projections 18, viewed in circumferential direction, are provided with an undercut, respectively.

In deviation from the mushroom shape configuration, the form fit connections can also have other contour shapes. They must only be designed such that the neighboring segments Ito VII in circumferential direction of the fan wheel cannot be separated from each other.

The cutouts 17 and the projections 18 are provided respectively on the cover ring sections 1 and the hub ring sections 6. They can also be provided only on the cover ring sections or only on the hub ring sections, depending on where high loads are to be expected on the respective fan wheel. Several cutouts 17 and complementary projections 18 can be provided also across the length of one rim 4, 9 or 5, 10. The vanes 11 are arranged on the segments I to VII such that they have a spacing relative to the cutouts 17 and the projections 18.

In the meaning of the invention, a projection 18 is a projecting form fit part and a cutout 17 a recess of at least approximately complementary shape on a rim 4, 9, 74 or 5, 10, 75.

In this embodiment, the segments I to VII embodied as one piece are also identical relative to each other so that only one single injection molding tool for the segments is required. The form fit elements 17, 18 provide an additional guide for joining the segments I to VII and ensure also an additional shape stability when the fan wheel is loaded in circumferential direction. Due to the form fit elements 17, 18, the segments Ito VII are not joined in a star shape to the fan wheel but in axial direction.

The neighboring segments I to VII are not only connected by form fit at the joining areas 15, 16 but also by an adhesive connection, a weld connection or the like, as has been explained in connection with the preceding embodiment. During the gluing or welding process, the segments I to VII that are contacting each other are advantageously strongly pressed against each other so that the connection at the joining areas 15, 16 is optimal. Neighboring segments can also be fixedly connected to each other by an adhesive or weld connection in the area of the form fit connection 17, 18.

In other embodiments according to the invention, form fit connections in circumferential direction can be realized also for axial fan wheels, diagonal fan wheels, or stators in a way equivalent to the described embodiment of FIG. 3. Such form fit connections can be realized also in case of the intermediate ring sections 71. In this case, there are also limitations with regard to the joining processes, i.e., the segments cannot be joined relative to each other in circumferential direction.

Figure 4:
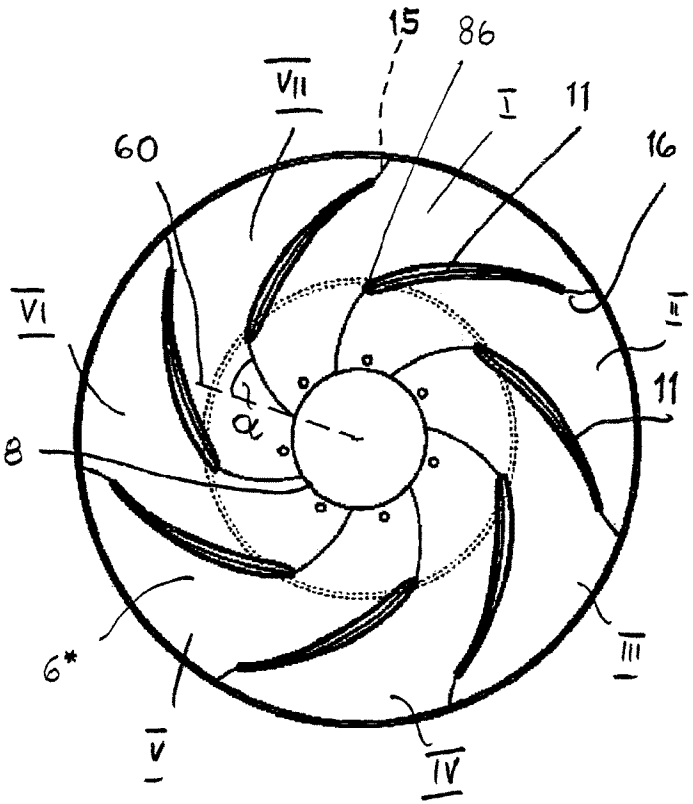
FIG. 4 a bottom view of a further embodiment of a fan wheel according to the invention that is assembled of several segments.

The fan wheel according to FIG. 4 has in the example also the segments I to VII formed as one piece. They are again identically configured so that they can be manufactured with a single injection molding tool. Similar to the embodiment according to FIG. 1, the segments I to VII are embodied such that they are arranged in a star shape and then pushed together, similar to the illustration of FIG. 15.

The segments Ito VII are designed such that, in addition to the joining areas 15, 16 on cover ring 1* and hub ring 6*, also further joining areas 86 (FIG. 4) in the area of the vanes 11 are generated. This has the advantage that the gluing or welding surface for joining neighboring segments is enlarged in comparison to the preceding embodiments. The segments Ito VII are designed in this context such that completed vanes 11 are not formed until neighboring segments are assembled.

Figure 5:
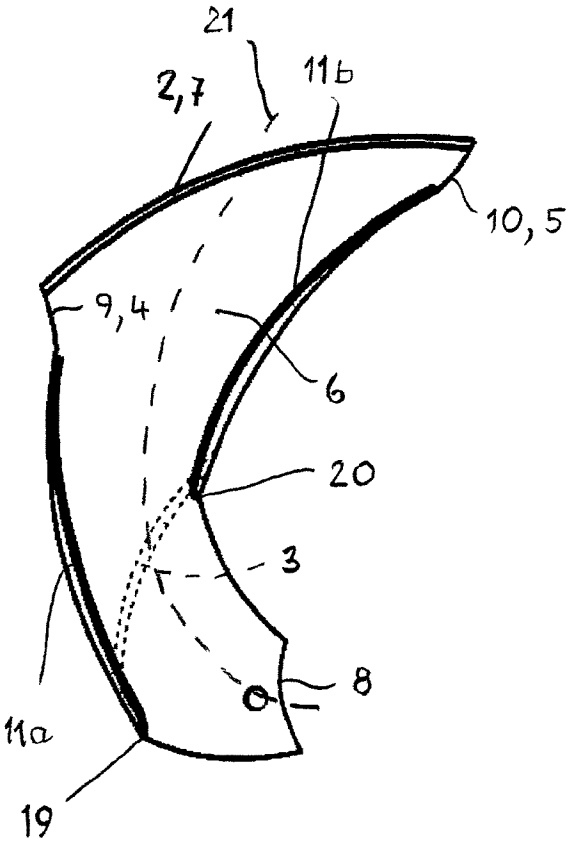
FIG. 5 in enlarged illustration a segment for producing the fan wheel according to FIG. 4.

FIG. 5 shows one of these segments in a bottom view from the side of the hub ring section 6. It has the curved outer rim 7 as well as the curved inner rim 8. The rim 10 which is connecting first ends of the rims 7, 8 extends, viewed in axial direction, in a curved shape. The oppositely positioned rim 9 connecting the second ends of the rims 7, 8 is extending, viewed in axial direction of the fan wheel, also across its length in a curved shape, namely, with substantially identical curvature course as rim 10 so that neighboring identical segments can be joined free of gaps. In direct connection with the two rims 9, 10, a vane part 11*a*, 11*b* is extending, respectively. The vane parts 11*a*, 11*b* extend between the hub ring section 6 and the cover ring section 1 (in FIG. 5 completely covered by hub ring section 6).

When neighboring segments I to VII are adjoined with their rims 4, 5, 9, 10, the vane parts 11*a*, 11*b* with their rims 19, 20 are contacting each other and form in this way the vane 11 which is hollow in this case. The rims 19 and 20 of neighboring segments which are contacting each other in the joined fan wheel form an additional joining area 86. In other respects, the vane 11 is of the same configuration as in the embodiments according to FIG. 1 or FIG. 3. The vane 11 is also arranged in the same way in relation to the cover ring 1* and the hub ring 6* of the fan wheel as in these embodiments.

When neighboring segments I to VII are connected to each other by an adhesive connection, then the adhesive is not only provided in the joining areas 15, 16 of the rings but also in the joining area 86 of the vanes 11. In this way, a very large gluing surface is provided which ensures a strong connection between neighboring segments I to VII that is capable of withstanding even high loads. When neighboring segments I to VII are connected to each other by a weld connection, in this embodiment the welding surface is enlarged by the area of the joining area 86 of the vane 11 which leads to an increased load capacity.

Since the vanes 11 are hollow, the fan wheel has a relatively minimal weight. Moreover, the hollow vanes 11 have the advantage that they enable in a simple way with respect to fluid mechanics the design of channels for targeted secondary flows.

After the joining process, edges, burrs, or the like can be present in the area of the joining areas 86 of the vanes 11; however, they can be easily removed in a conventional manner. The segments I to VII are identically embodied relative to each other and have, in the axial plan view, a center line 21 whose curvature course is identical to the curvature course of the rims 9, 10 in axial plan view. In this context, the width of the segment measured in circumferential direction decreases from the outer rim 2, 7 in the direction toward the inner rim 8 in such a way that the segment in the area of the outer rim 2, 7 has the greatest and in the area of the inner rim 8 the smallest circumferential width.

Due to the described configuration, the segments I to VII, as illustrated schematically with the aid of FIG. 15, can be pushed together in a star shape and in circumferential direction can be pressed against each other so that the segments Ito VII at the joining areas 15, 16, 86 are tightly contacting each other. The paths on which the segments are moved together during the joining process in rotation-symmetrical way, must be selected carefully as a function of the course of the joining areas 15, 16, 86 in order to avoid unwanted collisions. In particular, in some embodiments curved paths are required.

Since FIG. 5 shows the segment in a bottom view, only the inner rim 3 of the cover ring section 1 can be seen. The other rims 2, 4, 5 of the cover ring section 1 are, viewed in plan view onto the segment, congruent with the rims 7, 9, 10 of the hub ring section 6 across their length.

Figure 6:
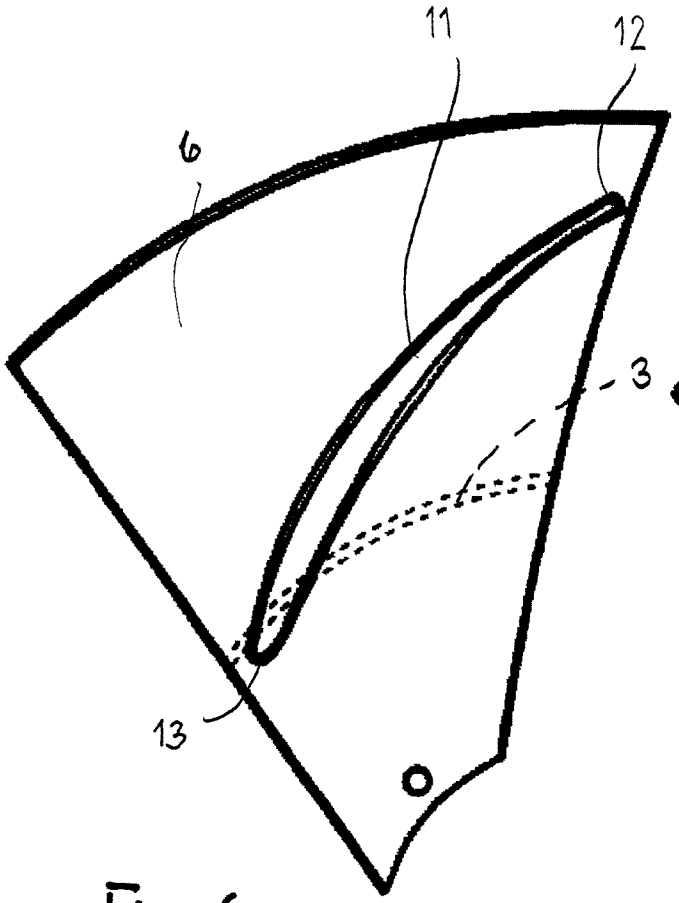
FIG. 6.

FIG. 6 shows, in a plan view onto the hub ring section 6, a segment that is of a similar configuration as the segment according to FIG. 2. The vane 11 is provided on the segments such that its two outflow side and inflow side ends 12, 13 have a spacing relative to the rims 4, 5, 9, 10. The vane 11 projects, as in the embodiment according to FIG. 2, radially slightly past the inner rim 3 of the cover ring section 1.

In contrast to the embodiment according to FIG. 2, the vane 11 is hollow. The vane 11 is not continuously hollow. The cavity ends in the area of the cover ring section 1 so that the latter is not interrupted by the cavity.

The hollow configuration of the vane 11 is achieved in the injection mold by means of a sliding core. Due to this sliding core, the vane 11 in the area of the hub ring section 6 is open. In order to avoid noise development as well as also dirt deposits within the vane 11 in use of the fan wheel, the vane 11 is advantageously covered after the injection molding process or after the joining process of the complete fan wheel by a cover or the like or is filled with a material, for example, with a foamed material. The cover can be glued on, welded or in other suitable ways fastened to the hub ring section 6. The closure member is advantageously designed such that it is positioned with its exterior side flush with the exterior side of the hub ring section 1. In order to achieve this, a recess into which the closure member is introduced so as to be flush at the surface must be provided on the injection molded part in the area of the cavity on the hub ring section 6.

FIG. 7 shows a segment that is in principle of the same configuration as the segment according to FIG. 6. The difference resides in that at least one reinforcement 22 is provided inside the hollow vane 11. The reinforcement 22 is in the form of a web which is extending between oppositely positioned side walls 23, 24 of the vane 11. The reinforcement 22 extends advantageously across the entire axial height of the vane 11. The reinforcement 22 provides an additional strength to the vane 11.

In the injection molding tool for producing the web-shaped reinforcement 22 two sliding cores are provided which are positioned at minimal spacing adjacent to each other so that the web 22 is formed between the sliding cores upon injection of the plastic material.

In the embodiments according to FIGS. 1, 3, and 4, the joining areas 15, 16 between the segments I to VII are not positioned on a radial line, viewed in axial direction of the fan wheel. Relative to a radial line 60 (FIGS. 1, 3, and 4) that is extending through the point of intersection between the respective separating line 15, 16 and the inner circular rim 8 of the fan wheel, the joining areas 15, 16 are positioned at an angle $\alpha$ to this radial line 60. Depending on the course of the separating lines 15, 16, the angle $\alpha$ increases in the direction from the inner rim 8 toward the outer rim 2.

The segments I to VII can also be designed such that the joining areas 15, 16 are positioned on the radial line 60 so that the angle $\alpha$ amounts to 0°.

The angle $\alpha$ can amount to up to approximately 80°, depending on the configuration of the segments I to VII. This angle range is independent of the manner in which the segments I to VII are connected to each other.

FIG. 25 shows a possible configuration of cross sections of joining areas 15, 16, 85 with which no joining surface enlarging effect is achieved. It shows in an exemplary way and in enlarged illustration a section A-A (see FIGS. 1, 3, 16, 18, 20) extending through a joining area 15, 16, 85 with contacting segment rims 4, 9, 74 and 5, 10, 75. The course of the joining area 15, 16, 85 in section is substantially that of a straight stretch which connects the inner side 30 with the exterior side 31 of the ring sections 1, 6, 71 at a shortest distance. The joining area 15, 16, 85 or the rims 4, 9, 74 and 5, 10, 75 of the segments I and II extend approximately perpendicularly to the inner side 30 and to the exterior side 31. This configuration is the simplest configuration for a cross section of a joining area. The corresponding tool construction for the injection molding tool is simple and inexpensive. A joining area designed in this way makes it also possible that the segments I and II are joined with each other in a direction transverse to the ring sections 1, 6, 71, as is required, for example, for the embodiment according to FIG. 3. However, the joining area 15, 16, 85 in this embodiment has a rather small surface for gluing or welding, and no additional form fit in axial or radial direction between the segments among each other is produced. Also, no additional guiding for the joining process is achieved.

With the aid of FIGS. 8 to 11, 14, and 26, possible configurations of cross sections of joining areas 15, 16, 85 are described in an exemplary fashion with which the joining surface can be significantly enlarged without the wall thicknesses of the rings 1*, 6*, 71* being enlarged and with which an at least partial form fit between neighboring segments I to VII with regard to displacements in axial and/or radial direction can be produced (joining surface enlarging designs). These Figures show, respectively, in an exemplary fashion and in enlarged illustration a section A-A (see FIGS. 1, 3, 16, 18, 20) extending through the joining area 15, 16, 85 with contacting segment rims 4, 9, 74 and 5, 10, 75. In these examples, the joining surface enlarging designs are provided that not only lead to an enlargement of the gluing/welding surface but in addition provide for increased shape stability of the joined segments. Also, due to these special designs of the joining areas 15, 16, 85 upon joining of the segments Ito VII to the fan wheel, a guiding action is also obtained that facilitates assembly of the segments to the fan wheel. Therefore, the manufacturing process of fan wheels according to the invention can be designed to be significantly more economical, faster, and more precise.

Figure 8:
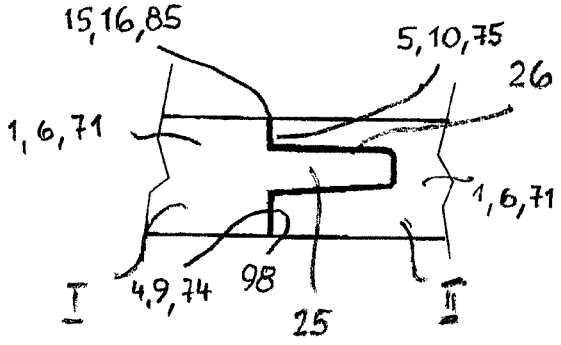

In an exemplary embodiment according to FIG. 8, a rim 4, 9, 74 of the segment I has a projecting tongue 25 that extends at least partially across the length (perpendicular to the drawing plane) of the rim 4, 9, 74. A rim 4, 9, 74 can also comprise several tongues 25 arranged in distribution about its length. The tongue 25 tapers in the direction toward its free end and is positioned approximately at half the thickness of the ring section 1, 6, 71.

An oppositely positioned rim 5, 10, 75 of a segment II is provided with at least one corresponding groove 26 in which the tongue 25 of the respective neighboring segment engages. The groove 26 is complementary to the respective tongue 25 and is positioned also approximately at half the thickness of the ring section 1, 6, 71. In the mounted position, the tongue 25 is resting areally against the side walls and the bottom of the groove 26. The joining area 15, 16, 85 that is formed by the two rims 4, 9, 74 and 5, 10, 75 of respective neighboring segments has a very thin layered design. Between the rims 4, 9, 74 and the rims 5, 10, 75, an adhesive is introduced into the joining area 15, 16, 85.

In the context of the invention, a tongue 25 is a projecting form fit part and a groove 26 is an at least approximately complementary recess in a rim 4, 9, 74 or 5, 10, 75.

The tongue 25 and the groove 26 are designed such that the ring sections 1, 6, 71 of the segments I, II abut each other so that no gap is formed at the exterior side and interior side of the joined rings 1*, 6*, 71*.

In order to be complete, it should be mentioned that switching of the features "groove" and "tongue" with respect to the rims 4, 5, 74 and 5, 10, 75 is also within the gist of the invention, which applies likewise also to the embodiments according to FIGS. 9 to 11, 14, and 26.

Figure 9:
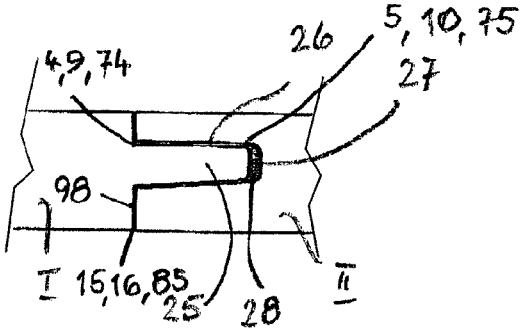

In the embodiment according to FIG. 9, the tongue 25 is designed such it has a minimal spacing relative to the side walls and to the bottom of the groove 26. In this way, in the joining area 15, 16, 85 a free space 27 is formed into which a viscous adhesive medium 28 can be introduced. In this embodiment, due to the free space 27 filled with adhesive 28 completely or partially, the joining area 15, 16, 85 has thus a rather more voluminous configuration. This adhesive can be introduced into the groove 26 prior to joining the two segments I, II. Structurally, the size of the free space 27 that exist after completion of joining of the segments I and II, is ensured by a stop 98, i.e., the segments I and II are moved toward each other until at least in the area of the stop 98 direct contact between the segment rings 4, 9, 74 and 5, 10, 75 is produced. Alternatively, it is possible to introduce the adhesive into the free space 27 perpendicularly to the drawing plane after having joined the two segments I and II.

In both described embodiments according to the FIGS. 8 and 9, the adhesive is advantageously applied also to the areas of the stop 98 so that the contacting segments I, II are fixedly connected to each other by the corresponding adhesive across a large surface area.

Figure 10:
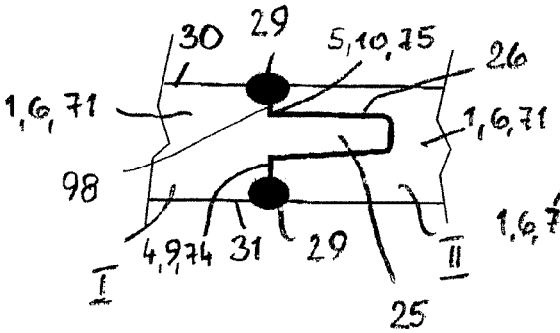

FIG. 10 shows a tongue and groove connection in which the connection of the segments I, II that are contacting each other with their rims 4, 9, 74 and 5, 10, 75 is realized by means of a more linear weld connection in the area of the inner side 30 or the exterior side 31 of the ring sections 1, 6, 71. The weld connection is illustrated by weld beads 29. The weld connection is provided in the area outside of the groove 26 so that the segments I, II with their end faces that are positioned outside of the groove 26 in the area of the stop 98 are contacting each other. In addition, the tongue 25 can be glued into the groove 26 as has been described above in connection with FIG. 8 or 9.

In the embodiment according to FIG. 11, the rims 4, 9, 74 and 5, 10, 75 of the segments I, II are stepped. Each segment rim 4, 9, 74 and 5, 10, 75 is comprised, viewed in section view, of a projecting form fit part 25* and a recess 26* that is complementary to the projecting form fit part 25* of the neighboring segment. The stepped configurations of the two rims 4, 9, 74 and 5, 10, 75 are embodied complementary to each other so that the segments I, II at the joining area 15, 16, 85 are resting areally against each other.

The joining area 15, 16, 85, viewed in section view, has end face areas 32, 33 that adjoin perpendicularly the inner side 30 as well as the exterior side 31 of the ring sections 1, 6, 71 and are connected to each other by a wall area 34. It extends advantageously at a minimal angle at a slant relative to the inner side 30 as well as the exterior side 31 of the segments I, II. The slantingly positioned wall area 34 facilitates joining of the neighboring segments I, II. Advantageously, the transitions between the end face areas 32, 33 and the wall area 34 are rounded in order to avoid crack formation.

In the end face areas 32, 33 and the wall area 34 an adhesive is applied so that the two segments I, II are reliably areally glued to each other at the joining area 15, 16, 85. The stepped configuration of the joining areas 15, 16, 85 is advantageously provided across their entire length.

The stepped configuration of the joining area 15, 16, 85 enables also a simple and problem-free joining process when producing the fan wheel.

In the embodiment according to FIG. 26, the joining surface enlarging effect is achieved in that the joining area 15, 16, 85, viewed in cross section, defines with the inner side 30 or the exterior side 31 of the ring sections 1, 6, 71 acute angles $\beta$ or $\beta^*$ that are significantly smaller than 90°, advantageously between 70° and 30°. When the joining area 15, 16, 85, viewed in cross section, is straight, $\beta$ and $\beta^*$ have approximately the same value. The joining area 15, 16, 85, viewed in section view, can however also extend in a curved shape so that the values of the two angles $\beta$ and $\beta^*$ can also differ significantly from each other.

The cross section configurations in particular according to FIGS. 8, 11, 25, and 26 are suitable also excellently for embodiments in which the segments I, II are connected to each other by an areal weld connection. With the aid of FIG. 14, an advantageous configuration of the tongue and groove connection similar to FIG. 8 is explained in detail that is suitable in particular for weld connections by laser welding, friction welding, vibration welding, hot gas welding or induction welding.

The ring sections 1, 6, 71 have a wall thickness D which can be in the range between approximately 3 mm to approximately 12 mm. An advantageous range is between approximately 4 mm and approximately 8 mm. A particularly preferred wall thickness D is approximately 6 mm. The groove 26 has a depth t that is in the range of approximately (0.7 to 2.5)·D. Advantageously, the groove depth is approximately twice the wall thickness D.

The tongue 25 tapers in its cross section in the direction toward its free end 35. In this way, the tongue 25 is self-centering during the joining process. Moreover, this tapering of the cross section is advantageous in regard to strength. Near the free end 35, the tongue 25 has a thickness d2 while near the stop 98 it has the greater thickness d1. The tongue 25 is positioned with its side walls areally against the side walls of the groove 26. The end face 35 of the tongue 25 has minimal spacing relative to the bottom 36 of the groove 26. In this way, it is ensured that the two segments I, II can be joined such that the flanks 39 and 40 of the tongue 25 are resting areally on the groove and that at the inner side 30 as well as the exterior side 31 of the rings 1*, 6*, 71* no gaps are produced.

Due to the tapering of the cross section of the tongue 25, the cross section of the areas 37, 38 of the ring sections 1, 6, 71 surrounding the groove 26, viewed from the free end of the groove beginning in the area of the stop 98, is increasing constantly. In the area of the cross sectional thickness d2, the tongue 25 is only loaded minimally while the surrounding area 37, 38 of the groove of the segment II is greatly loaded. The corresponding thick area 37, 38 can therefore absorb this load safely.

In the cross section area d1, on the other hand, the tongue 25 is strongly loaded so that the surrounding area 37, 38 of the groove of the segment II can be correspondingly designed to be weak.

The wedge angle between the two flanks 39, 40 of the tongue 25 is advantageously in a range between approximately 0.5° and approximately 8°.

The transition between the flanks 39, 40 of the tongue 25 and the stop 98 is rounded by the radius R1 on the segment I. This radius R1 amounts to advantageously approximately (0.05 to 0.3)·D. The same value or a minimally greater value can be selected for the complementary radius R1 on segment II in order to reliably avoid a premature collision of the segments I and II in the area of R1 during the joining process. In this way, in the area of R1 a very small gap would be generated (not illustrated in FIG. 14).

It is however advantageous to design this transition between the flanks 39, 40 and the stop 98 to be bionic, i.e., to provide no constant radius in this transition area. Advantageously, the curvature course of the transition is designed such that the radius of curvature at the stop 98 is small and increases continuously in the direction toward the flanks 39, 40. The bionic configuration of the transition has the advantage that in regard to the force flow from the tongue 25 into the ring section 1, 6, 71 of segment I it can be designed such a crack formation can be avoided.

The transition from the side walls of the groove 26 into the bottom side 36 of the groove 26 is rounded with the radius R2. It is advantageously (0.05 to 0.3)·D. In order to be able to ensure optimally the force flow, the rounded portion in the transition area is in particular advantageously bionically designed, i.e., no constant radius is provided. In this way, this rounded transition can be matched optimally to the loads that are occurring in use of the fan wheel in such a way that crack formations are avoided in any case. Advantageously, the curvature course of the transition is designed such that the curvature radius at the bottom 36 of the groove is small and becomes continuously greater in a pacing fashion in direction of the flanks 39, 40.

In the completely joined state, i.e., when the segments I and II abut each other at the stop 98, in the area of the flanks 39, 40 a pretension is advantageously already existing due to the compression of the segments I and II in the joining process. In this way, it is ensured that the flanks 39, 40 of the tongue 25 and the corresponding flanks of the groove 26 after joining are contacting each other without clearance.

When the segments I, II are connected to each other by laser welding in the joining area 15, 16, 85, a laser-absorbing liquid is applied onto the rims 4, 9, 74 and/or 5, 10, 75 prior to the joining process in an advantageous embodiment. After joining, during the welding process the laser light, which penetrates the specially employed material of the ring sections 1, 6, 71 which is transparent for the employed laser light, is converted in this area to heat so that neighboring material melts and is connected by material fusion. Since the absorbing liquid absorbs only a part of the laser light or becomes itself laser transparent due to the welding process, it is possible to weld with a single laser light source simultaneously in the area of both flanks 39 and 40 of the tongue 25.

When with a single laser light source welding is performed simultaneously in the area of both flanks 39 and 40 of the tongue 25, it can be advantageous when on both flanks 39 and 40 a liquid is applied, respectively, that absorbs laser light differently. On the flank 39 proximal to the laser light, a liquid can then be applied which absorbs laser light less strongly, while on the flank 40 which is remote from the laser light source a liquid is applied that absorbs laser light more strongly. In this way, a more uniform welding process relative to the flanks 39, 40 can be adjusted.

When such a welding process is performed, advantageously a special plastic material is employed as a material for the segments I to VII that is substantially transparent for the laser employed for welding. In an advantageous embodiment, the segments I-VII, in particular in the area of their rims 4, 9, 74 and 5, 10, 75 as well as their immediate environment, are not machined by cutting after the injection molding process because the surfaces otherwise have exceedingly laser light absorbing, laser light reflecting and/or laser light scattering properties. To the locations to be welded, substantially to the rims 4, 9, 74 and/or 5, 10, 75, a special liquid that absorbs laser light is applied in the described way prior to the welding process. It ensures that the energy of the laser light is converted precisely at the desired location to heat so that in this area the plastic material locally melts. This laser technology makes it possible to perform welding not only on the exterior surface of the ring 1*, 6*, 71* in the area of the inner side 30 and the exterior side 31, but also in internal areas of the joining areas 15, 16, 85 of the material of the fan wheel.

In an advantageous embodiment, the segments I-VII have a particularly smooth surface in the area of the inner side 30 and/or the exterior side 31 in immediate environment of the joining areas 15, 16, 85. This can be achieved, for example, by polishing the corresponding areas of the injection molding tool. In this way, the surfaces have to an even lesser degree laser light absorbing, laser light reflecting and/or laser light scattering properties; this has an advantageous effect in the laser welding process on injecting the laser light into the joining areas 15, 16, 85.

With the aid of FIG. 27*a*, an advantageous configuration of the tongue and groove connection between neighboring segments I, II is explained which is similarly designed to the embodiment according to FIG. 14. The embodiment according to FIG. 27*a* is particularly suitable for laser welding connections between the two segments I, II. The segment I has as a form fit part the tongue 25 whose flank 39 which is facing the top side 30 of the ring section 1, 6, 71 is fixedly welded to the side wall of the groove 26 in the ring section 1, 6, 71 of the segment II. This configuration is advantageous when welding at the flank 40 of the tongue 25 which is remote from the laser light source is not possible or only with difficulty, for example, due to the employed plastic material not having a sufficient laser light transparency. This has the result that at the flank 40 no or only a weakly carrying weld connection can be achieved by laser welding. A large part of or even the complete force transmission therefore takes place by means of the flank 39.

For this reason, the flank 39 is provided with a greater surface than the oppositely positioned flank 40. This has the result that the tongue 25, in contrast to the embodiments according to FIGS. 8 to 10 and 14, does not have a symmetric but an asymmetric cross section. This leads to an asymmetric force transmission between the two segments I and II. The asymmetric cross section configuration of the tongue 25 has the result that the areas 37, 38 of the ring section 1, 6, 71 of the segment II that are positioned on either side of the tongue 25 are asymmetrically designed, as viewed in the section view according to FIG. 27*a*. A large part of or the complete force transmission takes place through the area 37 that belongs to the greater flank 39. For this reason, this area 37 has a significantly greater thickness than the oppositely positioned area 38 which is also significantly shorter than the area 37, measured transverse to the thickness direction of the segments.

The tongue 25 in cooperation with the groove 26 fulfills the function of self-centering of the segments I and II upon joining to the fan wheel. Due to the wedge angle between the two flanks 39, 40, the required compression force for welding is achieved in the area of the flank 39 upon joining. In other respects, the explanations provided in regard to the embodiment according to FIG. 14 apply as well to this embodiment.

The flank 39 adjoins at an obtuse angle the stop 98 while the flank 40 is approximately positioned at a right angle relative to the stop 98' of the segment I or its ring section 1, 6, 71. Due to the asymmetric cross section configuration of the tongue 25 the two stops 98, 98' are staggered relative to each other transverse to the thickness direction of the segments I, II, as is shown in FIG. 27*a*. When joining, the segments I and II are moved toward each other until they come into contact with each other in the area of the stops 98, 98'. In the area of the stops 98, 98', an adhesive can be provided so that the joined segments I, II not only by laser welding but also by an adhesive connection are fixedly connected to each other. The two stops 98, 98' adjoin respectively at a right angle the top side 30 and the bottom side 31 of the segment I. The groove 26 as recess in the segment II is approximately complementary to tongue 25 so that the plugged-in segments I, II can be fixedly connected to each other in a reliable way. Also, in this way a proper force transmission is ensured.

The stops 98, 98' of the segment I form with the corresponding counter stops of the segment II the joining area 15, 16, 85.

FIG. 27*b* shows a similar configuration of the tongue and groove connection as FIG. 27*a*. This connection is also particularly suitable for laser welding connections. In order to enlarge the surface area of the flank 39 of the tongue 25 that is mainly transmitting the force as well as the area 37 that is mainly transmitting the force, the wall thickness is greater in the area of the joining area 15, 16, 85 than in the area outside of this joining area. For this purpose, the bottom side 31 of the ring section 1, 6, 71 of the segment I is designed with a curved configuration while the top side 30 is extending planar.

In the same way, the bottom side 31 of the ring section 1, 6, 71 of the segment II in the joining area is also provided with a curved configuration so that the wall thickness in the joining area increases. In the area outside of the joining area, the segments I, II have the wall thickness D. Within the joining area, the wall thickness $D_{max}$ of the segments I, II is greater than the wall thickness D in the area outside of the joining area. Advantageously, the wall thickness $D_{max}$ is in the range of 1.05 to 1.2 times the wall thickness D.

The area 38 of the segment II that serves only for centering and for applying the contact pressure during the joining process, projects past the remaining course of the bottom side 31

The described configuration of the tongue and groove connection makes it possible to increase the contact pressure on the flank 39 of the tongue 25 in the joining process in that a pressure or force is applied one-sided to the top side 30 in the joining area 15, 16, 85. In this way, the segments I, II are clamped remote from the joining area 15, 16, 85.

In other respects, this embodiment is of the same configuration as the embodiment according to FIG. 27*a*. Therefore, the explanations in regard to the embodiments according to FIGS. 14 and 27*a* apply likewise to the embodiment according to FIG. 27*b*.

FIG. 12 shows in perspective illustration a further embodiment of a segment for producing the fan wheel. FIG. 12 shows the principal configuration of the afore described segments. The segment embodied as one piece has the vane 11 which extends between the cover ring section 1 and the hub ring section 6. The cover ring section 1 has the curved outer rim 2 as well as the curved inner rim 3, viewed in plan view. In this embodiment, the outer rim 2 is provided with an angled portion 41 which extends across the circumferential length of the cover ring section 1.

The cover ring section 1 is upwardly curved at a spacing relative to the angled portion 41 such that the inner rim 3 has a greater axial spacing relative to the hub ring section 6 than the outer rim 2. The cover ring section 1 comprises the two rims 4, 5.

The hub ring section 6 has the curved outer rim 7 and the inner curved rim 8. At their two ends, the rims 7, 8 are connected to each other by the rims 9, 10. In the area of the outer rim 7, the hub ring section 6 is angled slightly opposite to the cover ring section 1. In other respects, the hub ring section 6 is of a planar configuration.

The rims 4, 9 are provided with tongues 25, as has already been described in connection with FIGS. 8-10 and 14. Correspondingly, the rims 5, 10 are provided with grooves 26. The tongues 25 are interrupted by cutouts 42, the grooves 26 are also interrupted by areas 43 that are complementary to the cutouts 42. The complementary cutouts and areas 42, 43 are designed such that joining is facilitated. In the joined state, the cutouts 42 and areas 43 provide an additional form fit in longitudinal direction of the joining area 15, 16. In this context, the cutouts and areas 42, 43 also provide due to their slantingly tapering shape that neighboring segments during joining position themselves correctly relative to each other (centering action).

Viewed in a plan view onto the segment, it has—with the exception of the configuration of the rims 4, 9, 74 and 5, 10, 75—the same contour shape as the segment according to FIG. 2. In this way, in relation to the arrangement of the rims of the cover ring section 1 and the hub ring section 6, reference is being had to the explanations provided there.

FIG. 22 shows in lateral plan view and in enlarged illustration a sector of the segment rim 4, 9, 74. In this embodiment, on the rim 4, 9, 74 the tongues 25 are provided wherein their cross section can be designed similar to what has been described in connection with FIGS. 8-10 and 14. Along the rim 4, 9, 74, interruptions 44 between the tongues 25 are present at approximately constant spacings. The groove (not illustrated) of the neighboring segment can be designed in this case to be continuous, i.e., without interruptions. The technical advantage that is achieved with these interruptions is that the flexibility of the tongues 25 with regard to minimal displacements transverse to the ring sections 1, 6, 71 is greater which is advantageous during joining for compensation of tolerances in direction transverse to the ring sections 1, 6, 71. The spacing a of two interruptions 44 in longitudinal direction is advantageously between 0.5 times the tongue depth t and 5 times t. At the base of a cutout between neighboring tongues 25 advantageously a rounded portion between two neighboring tongues 25 is provided which can be a complete rounded portion but also a bionic one, i.e., designed with a non-constant radius.

FIG. 13 shows finally in axial section one half of a radial fan wheel. It is reinforced by three straps 54 to 56 extending about its circumference. The straps are applied advantageously with pretension onto the fan wheel. The pretension can be in a range between approximately 10 N and approximately 10 kN, preferably approximately 10 to 100 N/m $m_2$ cross sectional surface area of the strap.

In the embodiment, the fan wheel has three straps 54 to 56. Depending on the size of the fan wheel, only one, two or more than three straps can be provided. The number of straps can be between 1 and 10. For the straps 54 to 56, preferably thermoplastic materials are used, such as polyamide (PA6, PA66, PA66/6, PAPA, PPA, PA 4.6, PA12), polyester (PBT, PET), polypropylene (PP), PPS, PES, PESU, PEEK, ABS, PC, ASA and the like. Preferably, a polyamide, a polypropylene or a polyester is used as material for the straps.

For the straps 54 to 56, also thermosetting resins can be used such as epoxide resin, urea resin or phenolic resin. Preferably, as a thermosetting resin an epoxide or phenolic resin system is used.

The straps 54 to 56 are advantageously reinforced with fibers, independent of whether they are comprised of a thermoplastic material or a thermosetting resin. As reinforcement fibers, glass, carbon, aramid, thermoplastic material (PET, PA) or natural fibers are conceivable such as flax, hemp, sisal, jute or coconut fiber.

The fibers are preferably endless fibers that can be produced simply and inexpensively. They can be introduced without problems into the plastic mass of the straps 54 to 56.

The straps 54 to 56 extend about the circumference of the fan wheel and are attached in a suitable way thereto. The straps 54 to 56 can be connected by welding to the fan wheel, for example. For the welding process, diode lasers but also other laser systems can be used. When the segments are manufactured of substantially laser transparent material, in an advantageous embodiment a laser absorbing liquid is applied prior to laser welding in the area of the straps 54 to 56 to be connected by welding. Ultrasonic welding can also be used for welding. Also, it is possible to produce a fixed connection between the straps and the fan wheel by friction in circumferential direction.

As a further possibility for connecting the straps 54 to 56 with the fan wheel, adhesive methods are also conceivable. As an adhesive, 1-component or 2-component adhesives are conceivable, such as polyurethane, acrylic, methacrylates or silicones, or solvent systems.

The connection between the straps 54 to 56 and the fan wheel can also be realized in that a curing thermosetting resin is wound onto them that cures after winding. In this way, a safe and fixed connection between the respective strap 54 to 56 and the fan wheel is achieved.

In the illustrated embodiment, the cover ring 1* is provided along its outer rim 2 with a circumferential extending groove 57 into which the strap 55 is placed. The groove 57 is thus present on the outer diameter of the cover ring 1*.

On the inner diameter of the cover ring 1* there is also a circumferentially extending groove 58 which receives the strap 54.

The hub ring 6* is provided on the outer diameter with a circumferentially extending groove 59 for the strap 56.

All grooves 57 to 59 are open in circumferential direction of the fan wheel. In this way, the straps 54 to 56 can be inserted easily into the grooves 57 to 59. The grooves 57 to 59 can be provided already during injection molding of the segments I to VII. Each of these segments comprises then in its cover ring section 1 or hub ring section 6 the corresponding ring groove section which upon joining of the segments I to VII form the ring grooves extending about the circumference of the fan wheel.

The groove side walls guide the straps 54 to 56 in axial direction so that they cannot slide off the fan wheel.

The straps 54 to 56 can be wound several times about the circumference of the fan wheel. Advantageously, the straps 54 to 56 are wound so many times about the circumference of the fan wheel that the grooves 57 to 59 are completely filled with the strap.

In principle, it is however sufficient when the respective strap 54 to 56 is wound only once about the circumference of the fan wheel wherein the two ends of the strap overlap each other. The overlap is advantageously at least 10 times the strap width up to maximally 20% of the circumference. For such a configuration, it is advantageous when the respective strap 54 to 56 has a width that corresponds to the width of the groove.

By means of the straps 54 to 56, the segments Ito VII are fixedly held together so that even at high loads, for example, at high rotary speeds and great diameters of the fan wheel, there is no danger that the segments become detached from each other.

When the fan wheels are provided with the described endless fiber reinforced straps 54 to 56, the fan wheels can be operated at higher rotary limit speeds.

The straps can also be provided on fan wheels that are not produced of segments but are of a one piece configuration. In such fan wheels, the straps 54 to 56, applied advantageously with pretension onto the fan wheel, also have an advantageous effect in particular in regard to increasing the rotary limit speed of the fan wheel.

The proportion of fibers in the straps 54 to 56 can advantageously be between 10 and 65 percent by volume, preferably between 25 and 60 percent by weight.

Also, axial fan wheels, diagonal fan wheels or stators can be reinforced advantageously in the described way with straps 54 to 56 on cover ring 1* and/or hub ring 6* and/or intermediate ring 76*.

In fan wheels which are manufactured of segments the occurrence of weld lines, as they inevitably occur during injection molding of complete wheels, can be completely avoided. Injection molding of individual segments, in particular of segments with only one vane 11, can be designed without generating weld lines. This point of weakness that is difficult to control can thus be avoided for fan wheel joined from segments. The strength of the joining areas 15, 16, 85 which is realized by gluing or welding connections can be achieved with the described elements of the invention.

The segments are each designed such that in the assembly process they can be joined respectively by an identical or similar movement. In FIG. 15, the segments I to VII are illustrated in the initial state in the left illustration. The movement arrows for each segment show that they perform the same joining movement. In this way, the assembly process is significantly simplified and facilitated. This type of joining is however possible only for those segments that at their rims 4, 9, 74; 5, 10, 75 have no projecting form fit elements which effect a form fit in circumferential direction, as is illustrated in an exemplary fashion in FIG. 3. In this case, the segments must be joined in axial direction because of the projection 18 and the cutout 17. In this case, the common movement direction of the segments can be the axial movement.

The fan wheel after the joining process can be postprocessed by cutting. This is, for example, important when in certain areas of the fan wheel a high true-running accuracy is required. This is, for example, expedient for the grooves 57 to 59 (FIG. 13) for the straps 54 to 56. Also, postprocessing is required, for example, with regard to the centering diameter as well as the outer diameter of the cover ring 1*  or the hub ring 6*. Also, the grooves 57 to 59 can be initially not provided in the segments I to VII and can be introduced by cutting after joining of the segments.

What is claimed is:

1. A fan wheel comprising vanes (11) arranged in distribution about a circumference of the fan wheel, wherein the vanes (11) in a circumferential direction of the fan wheel are connected to each other by at least one ring (1*, 6*, 71*), wherein the fan wheel is comprised of three or more segments (I to VII), each embodied as one piece, wherein the segments each comprise at least one ring section (1, 6, 71) of the at least one ring (1*, 6*, 71*) and further comprise either one of the vanes (11) or at least a section (11*a*, 11*b*) of the vanes (11), wherein the segments are joined to form the fan wheel, wherein in the fan wheel at least the ring sections (1, 6, 71) are contacting each other by rims (4, 9, 74 and 5, 10, 75) that are positioned transversely to the circumferential direction and form joining areas (15, 16, 85), wherein the ring sections (1, 6, 71) have a cross-sectional thickness (D) that, viewed in the circumferential direction of the fan wheel, does not change in the joining areas relative to neighboring areas, wherein at least one of the rims (4, 9, 74 and 5, 10, 75) of one of the ring sections (1, 6, 71) of each segment (I to VII) is provided with at least one projecting form fit part (25, 25*, 18) in a region between a top side (30) and a bottom side (31) of the ring section (1, 6, 71), wherein at least one of the rims (4, 9, 74 and 5, 10, 75) of one of the ring sections (1, 6, 71) of each segment (I to VII) is provided with at least one recess (26, 26*, 17) in the region between the top side (30) and the bottom side (31) of the ring section (1, 6, 71), wherein the at least one recess (26, 26*, 17) is approximately complementary to the projecting form fit part (25, 25*, 18) and is arranged within the cross-sectional thickness (D) of the ring section (1, 6, 71) and is delimited in a direction of the cross-sectional thickness (D) of the ring section (1, 6, 71) by side walls (37, 38) engaging from above and from below the projecting form fit part (25, 25*, 18) within the cross-sectional thickness (D) of the ring section (1, 6, 71), wherein, for obtaining a high load resistance in operation of the fan wheel, a cross-sectional thickness (d1, d2) of the projecting form fit part (25, 25*, 18) tapers in the direction of its free end, wherein a transition from at least one side face (39, 40) of the projecting form fit part (25, 25*, 18) into a stop (98, 33, 32) of the projecting form fit part (25, 25*, 18) is curved, and wherein the side walls (37, 38) that delimit the recess (26, 26*, 17) have a cross-sectional thickness that tapers in the direction toward their free end, wherein the side walls (37, 38) have their greatest cross-sectional thickness in a region of a smallest cross-sectional thickness of the projecting form fit part (25, 25*, 18) and wherein the side walls (37, 38) of the recess (26, 26*, 17) and the side faces (39, 40) of the projecting form fit part (25, 25*, 18) are joined immediately to each other such that the fan wheel withstands high loads in operation.

2. The fan wheel according to claim 1, wherein the recess is a groove (26) that is arranged in an area between the top side (30) and the bottom side (31) of the ring section (1, 6, 71).

3. The fan wheel according to claim 2, wherein the side walls of the groove (26) are approximately of the same cross-sectional thickness or have different cross-sectional thicknesses.

4. The fan wheel according to claim 2, wherein the at least one side face (39, 40) of the form fit part that is embodied as a tongue is greater than another side face of the form fit part embodied as a tongue.

5. The fan wheel according to claim 1, wherein the recess (26, 26*, 17) has a depth (t) that is in a range of approximately 0.7 to 2.5 times the cross-sectional thickness (D) of the ring section (1, 6, 71).

6. The fan wheel according to claim 1, wherein the transition of the at least one side face (39, 40) of the projecting form fit part (25, 25*, 18)) and the stop (98, 33, 32) of the projecting form fit part (25, 25*, 18) is realized at a radius (R1) that amounts to approximately 0.05 to 0.3 times the cross-sectional thickness (D) of the ring section (1, 6, 71).

7. The fan wheel according to claim 1, further comprising at least one hub ring (6*) that connects ends (96) of the vanes (11) facing the hub ring in the circumferential direction with each other, wherein the at least one hub ring is configured to connect the fan wheel to a drive motor.

8. The fan wheel according to claim 7, further comprising at least one cover ring (1*) that connects ends (91) of the vanes (11) facing the cover ring with each other in the circumferential direction.

9. The fan wheel according to claim 8, wherein the hub ring (6*) and the cover ring (1*) are arranged displaced to each other and the vanes (11) extend between the hub ring (6*) and the cover ring (1*).

10. The fan wheel according to claim 1, further comprising at least one cover ring (1*) that connects ends (91) of the vanes (11) facing the cover ring with each other in the circumferential direction.

11. The fan wheel according to claim 1, further comprising at least one intermediate ring (71*) connecting the vanes (11) in the circumferential direction with each other, wherein the at least one intermediate ring is connected to the vanes in an area between lateral ends of the vanes, wherein the segments (I-VII) each comprise at least one intermediate ring section (71) of the intermediate ring.

12. The fan wheel according to claim 1, wherein the segments (I to VII) are at least approximately identically embodied and are injection molded parts.

13. The fan wheel according to claim 1, wherein the rims (4, 9, 74; 5, 10, 75) of the ring sections (1, 6, 71) are substantially contacting each other congruently and form the joining areas (15, 16, 85) with which the segments (I to VII) that are neighboring each other are contacting each other areally.

14. The fan wheel according to claim 1, wherein the segments (I to VII) that are neighboring each other are connected to each other by gluing and/or welding at the joining areas (15, 16, 85).

15. The fan wheel according to claim 1, wherein inflow side ends and outflow side ends (12, 13) of the vanes (11) have a spacing relative to the joining areas (15, 16).

16. The fan wheel according to claim 1, further comprising at least one reinforcement strap (54 to 56), comprised of thermoplastic material or thermosetting resin and containing reinforcement parts, that is wound onto the at least one ring (1*, 6*, 71*) of the fan wheel.

17. The fan wheel according to claim 16, wherein the reinforcement parts are endless reinforcement fibers.

18. The fan wheel according to claim 16, wherein the at least one reinforcement strap (54 to 56) is fastened to the at least one ring (1*, 6*, 71*) of the fan wheel by welding or gluing.

19. The fan wheel according to claim 16, wherein the at least one ring (1*, 6*, 71*) of the fan wheel is provided with at least one circumferentially extending groove (57 to 59) configured to receive the at least one reinforcement strap (54 to 56).

20. A fan wheel comprising vanes (11) arranged in distribution about a circumference of the fan wheel, wherein the vanes (11) in a circumferential direction of the fan wheel are connected to each other by at least one ring (1*, 6*, 71*), wherein the fan wheel is comprised of three or more segments (I to VII), each embodied as one piece, wherein the segments each comprise at least one ring section (1, 6, 71) of the at least one ring (1*, 6*, 71*) and further comprise either one of the vanes (11) or at least a section (11*a*, 11*b*) of the vanes (11), wherein the segments are joined to form the fan wheel, wherein in the fan wheel at least the ring sections (1, 6, 71) are contacting each other by rims (4, 9, 74 and 5, 10, 75) that are positioned transversely to the circumferential direction and form joining areas (15, 16, 85), wherein the ring sections (1, 6, 71) each have a top side (30) and a bottom side (31), wherein at least one of the rims (4, 9, 74 and 5, 10, 75) of one of the ring sections (1, 6, 71) of each segment (I to VII) is provided with at least one projecting form fit part (25, 25*, 18) located in a region between the top side (30) and the bottom side (31) of the ring section (1, 6, 71) and provided with side faces (39, 40), wherein at least one of the rims (4, 9, 74 and 5, 10, 75) of one of the ring sections (1, 6, 71) of each segment (I to VII) is provided with at least one recess (26, 26*, 17) that is approximately complementary to the projecting form fit part (25, 25*, 18) and that is arranged within a cross-sectional thickness (D) of the ring section (1, 6, 17), wherein the at least one recess (26, 26*, 17) accommodates the projecting form fit part (25, 25*, 17) and is delimited in a direction of the cross-sectional thickness (D) of the ring section (1, 6, 71) by side walls (37, 38) engaging from above and from below the projecting form fit part (25, 25*, 18) within the cross-sectional thickness (D) of the ring section (1, 6, 71), wherein, for obtaining a high load resistance in operation of the fan wheel, a cross-sectional thickness (d1, d2) of the projecting form fit part (25, 25*, 18) tapers toward an end thereof accommodated in the at least one recess (26, 26*, 17), wherein a transition from at least one of the side faces (39, 40) of the projecting form fit part (25, 25*, 18) into a stop (98, 33, 32) of the projecting form fit part (25, 25*, 18) is curved, and wherein the side walls (37, 38) that delimit the recess (26, 26*, 17) have a cross-sectional thickness that tapers in the direction toward their free end, wherein the side walls (37, 38) have their greatest cross-sectional thickness in a region of a smallest cross-sectional thickness of the projecting form fit part (25, 25*, 18) and wherein the side walls (37, 38) of the recess (26, 26*, 17) and the side faces (39, 40) of the projecting form fit part (25,25*, 18) are joined immediately to each other such that the fan wheel withstands high loads in operation.

21. The fan wheel according to claim 20, wherein the cross-sectional thickness of the ring section (1, 6, 71) in an area of the recess (26, 26*, 17) is greater than the cross-sectional thickness (D) in an area outside of the recess.

* * * * *